US008311810B2

(12) United States Patent
Ishikawa et al.

(10) Patent No.: US 8,311,810 B2
(45) Date of Patent: Nov. 13, 2012

(54) REDUCED DELAY SPATIAL CODING AND DECODING APPARATUS AND TELECONFERENCING SYSTEM

(75) Inventors: Tomokazu Ishikawa, Osaka (JP); Takeshi Norimatsu, Hyogo (JP); Kok Seng Chong, Singapore (SG); Huan Zhou, Singapore (SG)

(73) Assignee: Panasonic Corporation, Osaka (JP)

( * ) Notice: Subject to any disclaimer, the term of this patent is extended or adjusted under 35 U.S.C. 154(b) by 242 days.

(21) Appl. No.: 12/679,814

(22) PCT Filed: Jul. 28, 2009

(86) PCT No.: PCT/JP2009/003557

§ 371 (c)(1), (2), (4) Date: Mar. 24, 2010

(87) PCT Pub. No.: WO2010/013450

PCT Pub. Date: Feb. 4, 2010

(65) Prior Publication Data

US 2010/0198589 A1 Aug. 5, 2010

(30) Foreign Application Priority Data

Jul. 29, 2008 (JP) ..... 2008-194414

(51) Int. Cl.
*G10L 21/00* (2006.01)
*G10L 19/02* (2006.01)
*H04R 5/00* (2006.01)

(52) U.S. Cl. ..... 704/205; 704/203; 704/201; 381/20

(58) Field of Classification Search ..... 704/200, 704/201, 213, 205, 500, 502, E19.005, 1, 704/2, 48; 381/20–23
See application file for complete search history.

(56) References Cited

U.S. PATENT DOCUMENTS

| | | | | |
|---|---|---|---|---|
| 5,970,461 | A * | 10/1999 | Chatterton | 704/500 |
| 7,653,533 | B2 * | 1/2010 | Pang et al. | 704/201 |
| 7,840,411 | B2 * | 11/2010 | Hotho et al. | 704/500 |
| 7,903,751 | B2 * | 3/2011 | Fiesel et al. | 375/260 |
| 7,979,282 | B2 * | 7/2011 | Kim et al. | 704/500 |
| 8,160,258 | B2 * | 4/2012 | Jung et al. | 381/2 |

(Continued)

FOREIGN PATENT DOCUMENTS

CN 101151658 3/2008

(Continued)

OTHER PUBLICATIONS

International Search Report issued Oct. 27, 2009 in International (PCT) Application No. PCT/JP2009/003557.

(Continued)

*Primary Examiner* — Jesse Pullias
(74) *Attorney, Agent, or Firm* — Wenderoth, Lind & Ponack, L.L.P.

(57) ABSTRACT

The delay in a multi-channel audio coding apparatus and a multi-channel audio decoding apparatus is reduced. The audio coding apparatus includes: a downmix signal generating unit that generates, in a time domain, a first downmix signal that is one of a 1-channel audio signal and a 2-channel audio signal from an input multi-channel audio signal; a downmix signal coding unit that codes the first downmix signal; a first t-f converting unit that converts the input multi-channel audio signal into a multi-channel audio signal in a frequency domain; and a spatial information calculating unit that generates spatial information for generating a multi-channel audio signal from a downmix signal.

18 Claims, 9 Drawing Sheets

U.S. PATENT DOCUMENTS

| | | | | |
|---|---|---|---|---|
| 2005/0053242 | A1 | 3/2005 | Henn et al. | |
| 2006/0009225 | A1* | 1/2006 | Herre et al. | 455/450 |
| 2006/0023888 | A1 | 2/2006 | Henn et al. | |
| 2006/0023891 | A1 | 2/2006 | Henn et al. | |
| 2006/0023895 | A1 | 2/2006 | Henn et al. | |
| 2006/0029231 | A1 | 2/2006 | Henn et al. | |
| 2006/0153408 | A1* | 7/2006 | Faller et al. | 381/307 |
| 2007/0244706 | A1* | 10/2007 | Tsushima | 704/500 |
| 2008/0008323 | A1* | 1/2008 | Hilpert et al. | 381/1 |
| 2008/0033729 | A1* | 2/2008 | Ko et al. | 704/500 |
| 2009/0010440 | A1* | 1/2009 | Jung et al. | 381/1 |
| 2010/0153118 | A1 | 6/2010 | Hotho et al. | |

FOREIGN PATENT DOCUMENTS

| | | |
|---|---|---|
| JP | 2004-535145 | 11/2004 |
| JP | 2007-79483 | 3/2007 |

OTHER PUBLICATIONS

Jürgen Herre et al., "*MPEG Surround—The ISO/MPEG Standard for Efficient and Compatible Multi-Channel Audio Coding*", Convention Paper 7084, Audio Engineering Society 122$^{nd}$ Convention, Vienna, Austria, May 5-8, 2007, pp. 1-23.

* cited by examiner

REDUCED DELAY SPATIAL CODING AND DECODING APPARATUS AND TELECONFERENCING SYSTEM

TECHNICAL FIELD

The present invention relates to an apparatus that implements coding and decoding with a lower delay, using a multi-channel audio coding technique and a multi-channel audio decoding technique, respectively. The present invention is applicable to, for example, a home theater system, a car stereo system, an electronic game system, a teleconferencing system, and a cellular phone.

BACKGROUND ART

The standards for coding multi-channel audio signals include the Dolby digital standard and Moving Picture Experts Group-Advanced Audio Coding (MPEG-AAC) standard. These coding standards implement transmission of the multi-channel audio signals by basically coding an audio signal of each channel in the multi-channel audio signals separately. These coding standards are referred to as discrete multi-channel coding, and the discrete multi-channel coding enables coding signals for 5.1 channel practically at a bit rate around 384 kbps as the lowest limit.

On the other hand, Spatial-Cue Audio Coding (SAC) is used for coding and transmitting multi-channel audio signals in a totally different method. An example of SAC is the MPEG surround standard. As described in NPL 1, the MPEG surround standard is to (i) downmix a multi-channel audio signal to one of a 1-channel audio signal and 2-channel audio signal, (ii) code the resulting downmix signal that is one of the 1-channel audio signal and the 2-channel audio signal using e.g., the MPEG-AAC standard (NPL 2) and the High-Efficiency (HE)-AAC standard (NPL 3) to generate a downmix coded stream, and (iii) add spatial information (spatial cues) simultaneously generated from each channel signal to the downmix coded stream.

The spatial information includes channel separation information that separates a downmix signal into signals included in a multi-channel audio signal. The separation information is information indicating relationships between the downmix signals and channel signals that are sources of the downmix signals, such as correlation values, power ratios, and differences between phases thereof. Audio decoding apparatuses decode the coded downmix signals using the spatial information, and generate the multi-channel audio signals from the downmix signals and the spatial information that are decoded. Thus, the multi-channel audio signals can be transmitted.

Since the spatial information to be used in the MPEG surround standard has a small amount of data, increment of information in one of a 1-channel downmix coded stream and a 2-channel downmix coded stream is minimized. Thus, since the multi-channel audio signals can be coded using information having the same amount of data as that of one of a 1-channel audio signal and a 2-channel audio signal, in accordance with the MPEG surround standard, the multi-channel audio signals can be transmitted at a lower bit rate, compared to those of the MPEG-AAC standard and the Dolby digital standard.

For example, a realistic sensations communication system exists as a useful application of the coding standard for coding signals with high quality sound at a low bit rate. Generally, two or more sites are interconnected through a bidirectional communication in the realistic sensations communication system. Then, coded data is mutually transmitted and received between or among the sites. An audio coding apparatus and an audio decoding apparatus in each of the sites codes and decodes the transmitted and received data, respectively.

FIG. 7 illustrates a configuration of a conventional multi-site teleconferencing system, which shows an example of coding and decoding audio signals when a teleconference is held at 3 sites.

In FIG. 7, each of the sites (sites 1 to 3) includes an audio coding apparatus and an audio decoding apparatus, and a bidirectional communication is implemented by exchanging audio signals through communication paths having a predetermined width.

In other words, the site 1 includes a microphone 101, a multi-channel coding apparatus 102, a multi-channel decoding apparatus 103 that responds to the site 2, a multi-channel decoding apparatus 104 that responds to the site 3, a rendering device 105, a speaker 106, and an echo canceller 107. The site 2 includes a multi-channel decoding apparatus 110 that responds to the site 1, a multi-channel decoding apparatus 111 that responds to the site 3, a rendering device 112, a speaker 113, an echo canceller 114, a microphone 108, and a multi-channel coding apparatus 109. The site 3 includes a microphone 115, a multi-channel coding apparatus 116, a multi-channel decoding apparatus 117 that responds to the site 2, a multi-channel decoding apparatus 118 that responds to the site 1, a rendering device 119, a speaker 120, and an echo canceller 121.

There are many cases where constituent elements in each site include an echo canceller for suppressing an echo occurring in a communication through the teleconferencing system. Furthermore, when the constituent elements in each site can transmit and receive multi-channel audio signals, there are cases where each site includes a rendering device using a Head-Related Transfer Function (HRTF) so that the multi-channel audio signals can be oriented in various directions.

For example, the microphone 101 collects an audio signal, and the multi-channel coding apparatus 102 codes the audio signal at a predetermined bit rate at the site 1. As a result, the coded audio signal is converted into a bit stream bs1, and the bit stream bs1 is transmitted to the sites 2 and 3. The multi-channel decoding apparatus 110 for decoding to a multi-channel audio signal decodes the transmitted bit stream bs1 into the multi-channel audio signal. The rendering device 112 renders the decoded multi-channel audio signal. The speaker 113 reproduces the rendered multi-channel audio signal.

Similarly, at the site 3, the multi-channel decoding apparatus 118 decodes a coded multi-channel audio signal, the rendering device 119 renders the decoded multi-channel audio signal, and the speaker 120 reproduces the rendered multi-channel audio signal.

Although the site 1 is a sender and the sites 2 and 3 are receivers in the aforementioned description, there are cases where (i) the site 2 may be a sender and the sites 1 and 3 may be receivers, and (ii) the site 3 may be a sender and the sites 1 and 2 may be receivers. These processes are concurrently repeated at all times, and thus the realistic sensations communication system works.

The main goal of the realistic sensations communication system is to bring a communication with realistic sensations. Thus, any of 2 sites that are interconnected to each other needs to reduce uncomfortable feelings from the bidirectional communication. Additionally, the other problem is that the bidirectional communication is costly.

Performing a bidirectional communication with less uncomfortable feelings and at lower cost needs to satisfy some requirements. The requirements for the coding standard in which an audio signal is coded includes (1) a shorter time period for coding the audio signal by the audio coding apparatus and for decoding the audio signal by the audio decoding apparatus, that is, lower algorithm delay by the coding standard, (2) enabling transmission of the audio signal at a lower bit rate, and (3) satisfying higher sound quality.

Since sound extremely degrades according to a decrease in a bit rate in accordance with e.g., the MPEG-AAC standard and the Dolby digital standard, the difficulty lies in maintaining sound quality high enough to convey realistic sensations and provide less communication cost. In contrast, the SAC standard including the MPEG surround standard enables reducing a transmission bit rate while maintaining the sound quality. Thus, the SAC standard is a coding standard relatively suitable for achieving the realistic sensations communication system with less communication cost.

In particular, the main idea of the MPEG surround standard that is superior in sound quality and that belongs to the SAC standard is that spatial information of an input signal is represented by parameters with a less amount of information, and a multi-channel audio signal is synthesized with the parameters and a downmix signal that is downmixed to one of a 1-channel audio signal and a 2-channel audio signal and transmitted. The reduction in the number of channels of an audio signal to be transmitted can reduce a bit rate in accordance with the SAC standard, which satisfies the requirement (2) that is important in the realistic sensations communication system, that is, enabling transmission of an audio signal at a lower bit rate. Compared to a conventional multi-channel coding standard, such as the MPEG-AAC standard and the Dolby digital standard, the SAC standard enables transmission of a signal with higher sound quality at an extremely lower bit rate, in particular, 192 Kbps in 5.1 channel, for example.

Thus, the SAC standard is a useful means for a realistic sensations communication system.

CITATION LIST

[Non Patent Literature]
[NPL 1]
ISO/IEC-23003-1
[NPL 2]
ISO/IEC-13818-3
[NPL 3]
ISO/IEC-14496-3:2005
[NPL 4]
ISO/IEC-14496-3:2005/Amd 1:2007

SUMMARY OF INVENTION

Technical Problem

Actually, the SAC standard has a significant problem to be applied to a realistic sensations communication system. The problem is that an amount of coding delay in accordance with the SAC standard becomes significantly larger, compared to that by a conventional discrete multi-channel coding, such as the MPEG-AAC standard and the Dolby digital standard. In order to solve the problem of the increased amount of coding delay in accordance with the MPEG-AAC, for example, the MPEG-AAC-Low Delay (LD) standard has been standardized as a technique of reducing the amount (NPL 4).

When a sampling frequency is 48 kHz, an audio coding apparatus codes an audio signal with a delay of approximately 42 milliseconds in its coding, and an audio decoding apparatus decodes an audio signal with a delay of approximately 21 milliseconds in its decoding, in accordance with the general MPEG-AAC standard. In contrast, in accordance with the MPEG-AAC-LD standard, an audio signal can be processed with an amount of coding delay half that of the general MPEG-AAC standard. The realistic sensations communication system that employs the MPEG-AAC-LD standard can smoothly communicate with a communication partner because of a smaller amount of coding delay. However, the MPEG-AAC-LD standard, enabling the lower coding delay, is a multi-channel coding technique solely based on the MPEG-AAC standard. Thus, it can neither effectively reduce a bit rate nor satisfy the requirements of a lower bit rate, higher sound quality, and lower coding delay at the same time, as by the MPEG-AAC standard.

In other words, the conventional discrete multi-channel coding, such as the MPEG-AAC-LD standard and the Dolby digital standard, has a difficulty in coding signals with a lower bit rate, higher sound quality, and lower coding delay.

FIG. 8 illustrates an analysis of an amount of coding delay in accordance with the MPEG surround standard that is a representative of the SAC standard. NPL 1 describes the details of the MPEG surround standard.

As illustrated in FIG. 8, an SAC coding apparatus (SAC encoder) includes a t-f converting unit 201, an SAC analyzing unit 202, an f-t converting unit 204, a downmix signal coding unit 205, and a multiplexing device 207. The SAC analyzing unit 202 includes a downmixing unit 203 and a spatial information calculating unit 206.

An SAC decoding apparatus (SAC decoder) includes a demultiplexing device 208, a downmix signal decoding unit 209, a t-f converting unit 210, an SAC synthesis unit 211, and an f-t converting unit 212.

In FIG. 8, the t-f converting unit 201 converts a multi-channel audio signal into a signal in a frequency domain in the SAC coding apparatus. There are cases where the t-f converting unit 201 converts a multi-channel audio signal into a signal in a pure frequency domain using, for example, the Finite Fourier Transform (FFT) and the Modified Discrete Cosine Transform (MDCT), and converts a multi-channel audio signal into a signal in a combined frequency domain using, for example, a Quadrature Mirror Filter (QMF) bank.

The multi-channel audio signal converted into the one in the frequency domain is connected to 2 paths in the SAC analyzing unit 202. One of the paths is connected to the downmixing unit 203 that generates an intermediate downmix signal IDMX that is one of a 1-channel audio signal and a 2-channel audio signal. The other one of the paths is connected to the spatial information calculating unit 206 that extracts and quantizes spatial information. In many cases, the spatial information is generally generated using, for example, level differences, power ratios, correlations, and coherences among channels of each input multi-channel audio signal.

After the spatial information calculating unit 206 extracts and quantizes the spatial information, the f-t converting unit 204 reconverts the intermediate downmix signal IDMX into a signal in a time domain.

The downmix signal coding unit 205 codes a downmix signal DMX obtained by the f-t converting unit 204.

The coding standard for coding the downmix signal DMX is a standard for coding one of a 1-channel audio signal and a 2-channel audio signal. The standard may be a lossy compression standard, such as the MPEG Audio Layer-3 (MP3) standard, MPEG-AAC, Adaptive Transform Acoustic Coding (ATRAC) standard, the Dolby digital standard, and the Windows (trademark) Media Audio (WMA) standard, and may be a lossless compression standard, such as the MPEG4-Audio Lossless (ALS) standard, the Lossless Predictive Audio Compression (LPAC) standard, and the Lossless Transform Audio Compression (LTAC) standard. Furthermore, the coding standard may be a compression standard that specializes in the field of speech compression, such as Internet Speech Audio Codec (iSAC), internet Low Bitrate Codec (iLBC), and Algebraic Code Excited Linear Prediction (ACELP).

The multiplexing device 207 is a multiplexer including a mechanism for providing a single signal from two or more inputs. The multiplexing device 207 multiplexes the coded downmix signal DMX and spatial information, and transmits a coded bit stream to an audio decoding apparatus.

The audio decoding apparatus receives the coded bit stream generated by the multiplexing device 207. The demultiplexing device 208 demultiplexes the received bit stream. Here, the demultiplexing device 208 is a demultiplexer that provides signals from a single input signal, and is a separating unit that separates the single input signal into the signals.

Then, the downmix signal decoding unit 209 decodes the coded downmix signal included in the bit stream into one of the 1-channel audio signal and the 2-channel audio signal.

The t-f converting unit 210 converts the decoded signal into the signal in the frequency domain.

The SAC synthesis unit 211 synthesizes the multi-channel audio signal with the spatial information separated by the demultiplexing device 208 and the decoded signal in the frequency domain.

The f-t converting unit 212 converts the resulting signal in the frequency domain into a signal in the time domain to generate a multi-channel audio signal in the time domain consequently.

Considering the configuration of the SAC described above, algorithm delay amounts generated by the constituent elements in FIG. 8 in accordance with the SAC coding standard can be categorized into the following 3 sets of units.

(1) the SAC analyzing unit 202 and the SAC synthesis unit 211

(2) the downmix signal coding unit 205 and the downmix signal decoding unit 209

(3) the t-f converting units and the f-t converting units (201, 204, 210, 212)

FIG. 9 illustrates algorithm delay amounts in the conventional SAC coding technique. Each algorithm delay amount is denoted as follows for convenience.

The delay amounts in the t-f converting unit 201 and the t-f converting unit 210 are respectively denoted as D0, the delay amount in the f-t converting unit 202 is denoted as D1, the delay amounts in the f-t converting unit 204 and the f-t converting unit 212 are respectively denoted as D2, the delay amount in the downmix signal coding unit 205 is denoted as D3, the delay amount in the downmix signal decoding unit 209 is denoted as D4, and the delay amount in the SAC synthesis unit 211 is denoted as D5.

As illustrated in FIG. 9, a total delay amount D by combining the delay amounts of the audio coding apparatus and the audio decoding apparatus is $$D=2*D0+D1+2*D2+D3+D4+D5.$$

The algorithm delay of 2240 samples occurs in the audio coding apparatus and the audio decoding apparatus in accordance with the MPEG surround standard that is a typical example of the SAC coding standard. The total algorithm delay amount including the amount occurring in downmix signals from the audio coding apparatus and the audio decoding apparatus becomes enormous. The algorithm delay when a downmix coding apparatus and a downmix decoding apparatus employ the MPEG-AAC standard is approximately 80 milliseconds. However, in order that a realistic sensations communication system that generally prioritizes the delay amount performs a communication with disregard for the delay amount, the delay amount in each of the audio coding apparatus and the audio decoding apparatus needs to be kept no longer than 40 milliseconds.

Thus, there is an essential problem that the delay amount is extremely larger when the SAC coding standard is employed to the realistic sensations communication system and others that require a lower bit rate, higher sound quality, and lower coding delay.

Thus, the object of the present invention is to provide an audio coding apparatus and an audio decoding apparatus that can reduce the algorithm delay occurring in a conventional coding apparatus and a conventional decoding apparatus for processing a multi-channel audio signal.

Solution to Problem

In order to solve the problems, the audio coding apparatus according to an aspect of the present invention is an audio coding apparatus that codes an input multi-channel audio signal, the apparatus including: a downmix signal generating unit configured to generate a first downmix signal by downmixing the input multi-channel audio signal in a time domain, the first downmix signal being one of a 1-channel audio signal and a 2-channel audio signal; a downmix signal coding unit configured to code the first downmix signal generated by the downmix signal generating unit; a first t-f converting unit configured to convert the input multi-channel audio signal into a multi-channel audio signal in a frequency domain; and a spatial information calculating unit configured to generate spatial information by analyzing the multi-channel audio signal in the frequency domain, the multi-channel audio signal being obtained by the first t-f converting unit, and the spatial information being information for generating a multi-channel audio signal from a downmix signal.

With the configuration, the audio coding apparatus can execute a process of downmixing and coding a multi-channel audio signal without waiting for completion of a process of generating spatial information from the multi-channel audio signal. In other words, the processes can be executed in parallel. Thus, the algorithm delay in the audio coding apparatus can be reduced.

Furthermore, the audio coding apparatus may further include: a second t-f converting unit configured to convert the first downmix signal generated by the downmix signal generating unit into a first downmix signal in the frequency domain; a downmixing unit configured to downmix the multi-channel audio signal in the frequency domain to generate a second downmix signal in the frequency domain, the multi-channel audio signal being obtained by the first t-f converting unit; and a downmix compensation circuit that calculates downmix compensation information by comparing (i) the first downmix signal obtained by the second t-f converting unit and (ii) the second downmix signal generated by the downmixing unit, the downmix compensation information being information for adjusting the downmix signal, and the first downmix signal and the second downmix signal being in the frequency domain.

With the configuration, the downmix compensation information can be generated for adjusting the downmix signal generated without waiting for the completion of the process of generating the spatial information. Furthermore, the audio decoding apparatus can generate a multi-channel audio signal with higher sound quality, using the generated downmix compensation information.

Furthermore, the audio coding apparatus may further include a multiplexing device configured to store the downmix compensation information and the spatial information in a same coded stream.

The configuration makes it possible to maintain compatibility with a conventional audio decoding apparatus and a conventional audio decoding apparatus.

Furthermore, the downmix compensation circuit may calculate a power ratio between signals as the downmix compensation information.

With the configuration, the audio decoding apparatus that receives the downmix signal and the downmix compensation information from the audio coding apparatus according to an aspect of the present invention can adjust the downmix signal using the power ratio that is the downmix compensation information.

Furthermore, the downmix compensation circuit may calculate a difference between signals as the downmix compensation information.

With the configuration, the audio decoding apparatus that receives the downmix signal and the downmix compensation information from the audio coding apparatus according to an aspect of the present invention can adjust the downmix signal using the difference that is the downmix compensation information.

Furthermore, the downmix compensation circuit may calculate a predictive filter coefficient as the downmix compensation information.

With the configuration, the audio decoding apparatus that receives the downmix signal and the downmix compensation information from the audio coding apparatus according to an aspect of the present invention can adjust the downmix signal using the predictive filter coefficient that is the downmix compensation information.

Furthermore, the audio decoding apparatus according to an aspect of the present invention may be an audio decoding apparatus that decodes a received bit stream into a multi-channel audio signal, the apparatus including: a separating unit configured to separate the received bit stream into a data portion and a parameter portion, the data portion including a coded downmix signal, and the parameter portion including (i) spatial information for generating a multi-channel audio signal from a downmix signal and (ii) downmix compensation information for adjusting the downmix signal; a downmix adjustment circuit that adjusts the downmix signal using the downmix compensation information included in the parameter portion, the downmix signal being obtained from the data portion and being in a frequency domain; a multi-channel signal generating unit configured to generate a multi-channel audio signal in the frequency domain from the downmix signal adjusted by the downmix adjustment circuit, using the spatial information included in the parameter portion, the downmix signal being in the frequency domain; and a f-t converting unit configured to convert the multi-channel audio signal that is generated by the multi-channel signal generating unit and is in the frequency domain, into a multi-channel audio signal in a time domain.

The configuration makes it possible to generate a multi-channel audio signal with higher sound quality, from the downmix signal received from the audio coding apparatus that reduces the algorithm delay.

Furthermore, the audio decoding apparatus may further include: a downmix intermediate decoding unit configured to generate the downmix signal in the frequency domain by dequantizing the coded downmix signal included in the data portion; and a domain converting unit configured to convert the downmix signal that is generated by the downmix intermediate decoding unit and is in the frequency domain, into a downmix signal in a frequency domain having a component in a time axis direction, wherein the downmix adjustment circuit may adjust the downmix signal obtained by the domain converting unit, using the downmix compensation information, the downmix signal being in the frequency domain having the component in the time axis direction.

With the configuration, processes prior to the process of generating the multi-channel audio signal are performed in a frequency domain. Thus, a delay in the processes can be reduced.

Furthermore, the downmix adjustment circuit may obtain a power ratio between signals as the downmix compensation information, and adjust the downmix signal by multiplying the downmix signal by the power ratio.

With the configuration, the downmix signal received by the audio decoding apparatus is adjusted to a downmix signal suitable for generating a multi-channel audio signal with higher sound quality, using the power ratio calculated by the audio coding apparatus.

Furthermore, the downmix adjustment circuit may obtain a difference between signals as the downmix compensation information, and adjust the downmix signal by adding the difference to the downmix signal.

With the configuration, the downmix signal received by the audio decoding apparatus is adjusted to a downmix signal suitable for generating a multi-channel audio signal with higher sound quality, using the difference calculated by the audio coding apparatus.

Furthermore, the downmix adjustment circuit may obtain a predictive filter coefficient as the downmix compensation information, and adjust the downmix signal by applying, to the downmix signal, a predictive filter using the predictive filter coefficient.

With the configuration, the downmix signal received by the audio decoding apparatus is adjusted to a downmix signal suitable for generating a multi-channel audio signal with higher sound quality, using the predictive filter coefficient calculated by the audio coding apparatus.

Furthermore, the audio coding and decoding apparatus according to an aspect of the present invention may be an audio coding and decoding apparatus including (i) an audio coding device that codes an input multi-channel audio signal; and (ii) an audio decoding device that decodes a received bit stream into a multi-channel audio signal, the audio coding device including: a downmix signal generating unit configured to generate a first downmix signal by downmixing the input multi-channel audio signal in a time domain, the first downmix signal being one of a 1-channel audio signal and a 2-channel audio signal; a downmix signal coding unit configured to code the first downmix signal generated by the downmix signal generating unit; a first t-f converting unit configured to convert the input multi-channel audio signal into a multi-channel audio signal in a frequency domain; a spatial information calculating unit configured to generate spatial information by analyzing the multi-channel audio signal in the frequency domain, the multi-channel audio signal being obtained by the first t-f converting unit, and the spatial information being information for generating a multi-channel audio signal from a downmix signal; a second t-f converting unit configured to convert the first downmix signal generated by the downmix signal generating unit into a first downmix signal in the frequency domain; a downmixing unit configured to downmix the multi-channel audio signal in the frequency domain to generate a second downmix signal in the frequency domain, the multi-channel audio signal being obtained by the first t-f converting unit; and a downmix compensation circuit that calculates downmix compensation information by comparing (i) the first downmix signal obtained by the second t-f converting unit and (ii) the second downmix signal generated by the downmixing unit, the downmix compensation information being information for adjusting the downmix signal, and the first downmix signal and the second downmix signal being in the frequency domain, and the audio decoding device including: a separating unit configured to separate the received bit stream into a data portion and a parameter portion, the data portion including a coded downmix signal, and the parameter portion including (i) spatial information for generating a multi-channel audio signal from a downmix signal and (ii) downmix compensation information for adjusting the downmix signal; a downmix adjustment circuit that adjusts the downmix signal using the downmix compensation information included in the parameter portion, the downmix signal being obtained from the data portion and being in a frequency domain; a multi-channel signal generating unit configured to generate a multi-channel audio signal in the frequency domain from the downmix signal adjusted by the downmix adjustment circuit, using the spatial information included in the parameter portion, the downmix signal being in the frequency domain; and a f-t converting unit configured to convert the multi-channel audio signal that is generated by the multi-channel signal generating unit and is in the frequency domain, into a multi-channel audio signal in a time domain.

With the configuration, the audio coding and decoding apparatus can be used as an audio coding and decoding apparatus that satisfies lower delay, lower bit rate, and higher sound quality.

Furthermore, the teleconferencing system according to an aspect of the present invention may be a teleconferencing system including (i) an audio coding device that codes an input multi-channel audio signal; and (ii) an audio decoding device that decodes a received bit stream into a multi-channel audio signal, the audio coding device including: a downmix signal generating unit configured to generate a first downmix signal by downmixing the input multi-channel audio signal in a time domain, the first downmix signal being one of a 1-channel audio signal and a 2-channel audio signal; a downmix signal coding unit configured to code the first downmix signal generated by the downmix signal generating unit; a first t-f converting unit configured to convert the input multi-channel audio signal into a multi-channel audio signal in a frequency domain; a spatial information calculating unit configured to generate spatial information by analyzing the multi-channel audio signal in the frequency domain, the multi-channel audio signal being obtained by the first t-f converting unit, and the spatial information being information for generating a multi-channel audio signal from a downmix signal; a second t-f converting unit configured to convert the first downmix signal generated by the downmix signal generating unit into a first downmix signal in the frequency domain; a downmixing unit configured to downmix the multi-channel audio signal in the frequency domain to generate a second downmix signal in the frequency domain, the multi-channel audio signal being obtained by the first t-f converting unit; and a downmix compensation circuit that calculates downmix compensation information by comparing (i) the first downmix signal obtained by the second t-f converting unit and (ii) the second downmix signal generated by the downmixing unit, the downmix compensation information being information for adjusting the downmix signal, and the first downmix signal and the second downmix signal being in the frequency domain, and the audio decoding device including: a separating unit configured to separate the received bit stream into a data portion and a parameter portion, the data portion including a coded downmix signal, and the parameter portion including (i) spatial information for generating a multi-channel audio signal from a downmix signal and (ii) downmix compensation information for adjusting the downmix signal; a downmix adjustment circuit that adjusts the downmix signal using the downmix compensation information included in the parameter portion, the downmix signal being obtained from the data portion and being in a frequency domain; a multi-channel signal generating unit configured to generate a multi-channel audio signal in the frequency domain from the downmix signal adjusted by the downmix adjustment circuit, using the spatial information included in the parameter portion, the downmix signal being in the frequency domain; and a f-t converting unit configured to convert the multi-channel audio signal that is generated by the multi-channel signal generating unit and is in the frequency domain, into a multi-channel audio signal in a time domain.

With the configuration, the teleconferencing system can be used as a teleconferencing system that can implement a smooth communication.

Furthermore, the audio coding method according to an aspect of the present invention may be an audio coding method for coding an input multi-channel audio signal, the method including: generating a first downmix signal by downmixing the input multi-channel audio signal in a time domain, the first downmix signal being one of a 1-channel audio signal and a 2-channel audio signal; coding the first downmix signal generated in the generating of a first downmix signal; converting the input multi-channel audio signal into a multi-channel audio signal in a frequency domain; and generating spatial information by analyzing the multi-channel audio signal in the frequency domain, the multi-channel audio signal being obtained in the converting, and the spatial information being information for generating a multi-channel audio signal from a downmix signal.

With the method, the algorithm delay occurring in a process of coding an audio signal can be reduced.

Furthermore, the audio decoding method according to an aspect of the present invention may be an audio decoding method for decoding a received bit stream into a multi-channel audio signal, the method including: separating the received bit stream into a data portion and a parameter portion, the data portion including a coded downmix signal, and the parameter portion including (i) spatial information for generating a multi-channel audio signal from a downmix signal and (ii) downmix compensation information for adjusting the downmix signal; adjusting the downmix signal using the downmix compensation information included in the parameter portion, the downmix signal being obtained from the data portion and being in a frequency domain; generating a multi-channel audio signal in the frequency domain from the downmix signal adjusted in the adjusting, using the spatial information included in the parameter portion, the downmix signal being in the frequency domain; and converting the multi-channel audio signal that is generated in the generating and is in the frequency domain, into a multi-channel audio signal in a time domain.

With the method, the multi-channel audio signal with higher sound quality can be generated.

Furthermore, the program for an audio coding apparatus according to an aspect of the present invention may be a program for an audio coding apparatus that codes an input multi-channel audio signal, wherein the program may cause a computer to execute the audio coding method.

The program can be used as a program for performing audio coding processing with lower delay.

Furthermore, the program for an audio decoding apparatus may be a program for an audio decoding apparatus that decodes a received bit stream into a multi-channel audio signal, wherein the program may cause a computer to execute the audio decoding method.

The program can be used as a program for generating a multi-channel audio signal with higher sound quality.

As described above, the present invention can be implemented not only as such an audio coding apparatus and an audio decoding apparatus, but also as an audio coding method and an audio decoding method, using characteristic units included in the audio coding apparatus and the audio decoding apparatus, respectively as steps. Furthermore, the present invention can be implemented as a program causing a computer to execute such steps. Furthermore, the present invention can be implemented as a semiconductor integrated circuit integrated with the characteristic units included in the audio coding apparatus and the audio decoding apparatus, such as an LSI. Obviously, such a program can be provided by recording media, such as a CD-ROM, and via transmission media, such as the Internet.

Advantageous Effects of Invention

The audio coding apparatus and the audio decoding apparatus according to the present invention can reduce the algorithm delay occurring in a conventional multi-channel audio coding apparatus and a conventional multi-channel audio decoding apparatus, and maintain a relationship between a bit rate and sound quality that is in a trade-off relationship, at high levels.

In other words, the present invention can reduce the algorithm delay much more than that by the conventional multi-channel audio coding technique, and thus has an advantage of enabling the construction of e.g., a teleconferencing system that provides a real-time communication and a communication system which brings realistic sensations and in which transmission of a multi-channel audio signal with lower delay and high sound quality is a must.

Accordingly, the present invention makes it possible to transmit and receive a signal with higher sound quality and lower delay and at a lower bit rate. Thus, the present invention is highly suitable for practical use, in recent days where mobile devices, such as cellular phones bring communications with realistic sensations and audio-visual devices and teleconferencing systems have widely spread the full-fledged communication with realistic sensations. The application is not limited to these devices, and obviously, the present invention is effective for overall bidirectional communications in which lower delay amount is a must.

DESCRIPTION OF EMBODIMENTS

Hereinafter, Embodiments in the present invention will be described with reference to the drawings.

[Embodiment 1]

First, Embodiment 1 in the present invention will be described.

Figure 1:
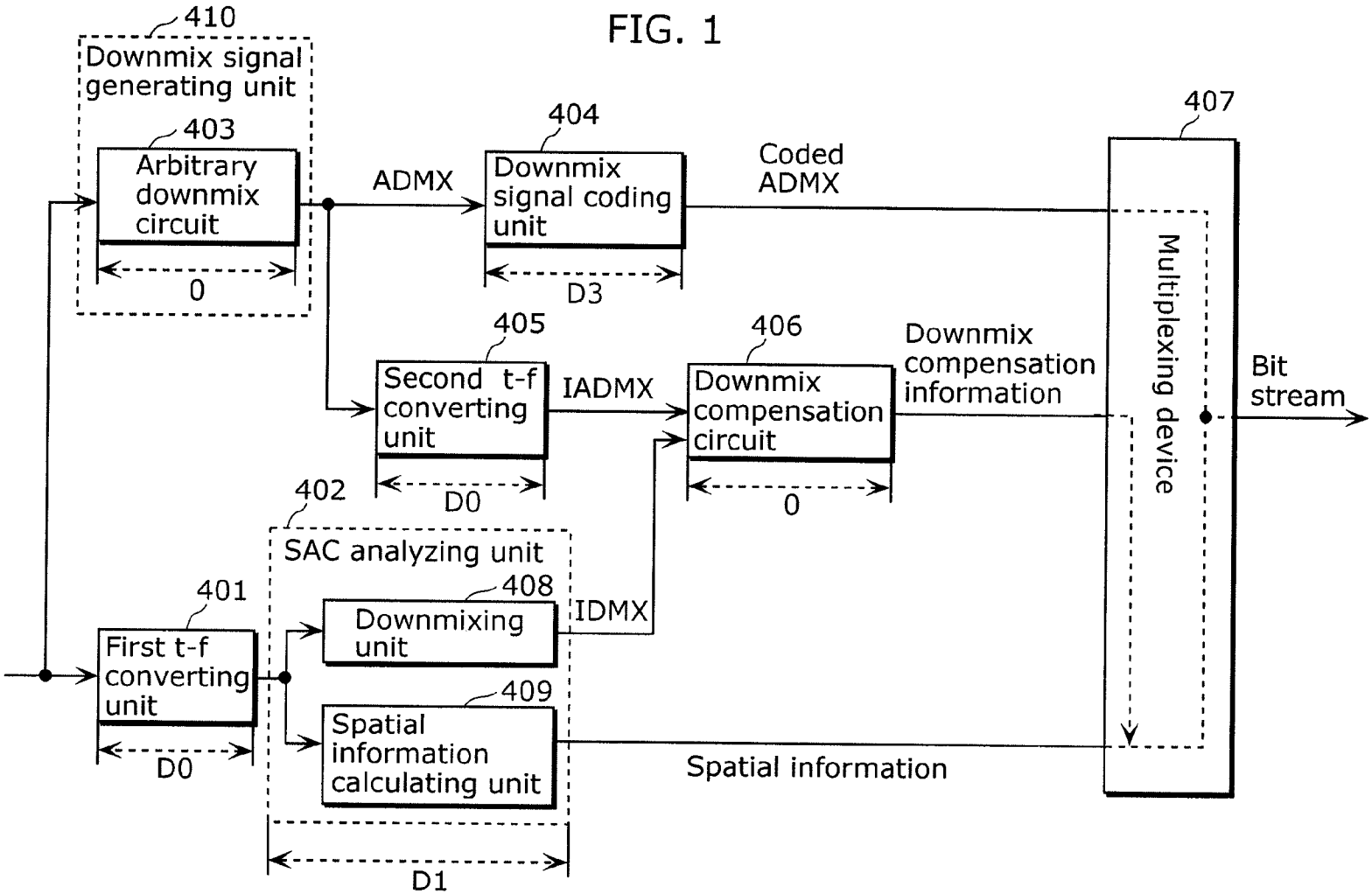
FIG. 1 illustrates a configuration of an audio coding apparatus and a delay amount in each constituent element according to an embodiment in the present invention.

FIG. 1 illustrates an audio coding apparatus according to Embodiment 1 in the present invention. Furthermore, a delay amount is shown under each constituent element in FIG. 1. The delay amount corresponds to a time period between storage of input signals and output signals. When no plural input signals is stored between an input and an output, the delay amount that is negligible is denoted as "0" in FIG. 1.

The audio coding apparatus in FIG. 1 is an audio coding apparatus that codes a multi-channel audio signal, and includes a downmix signal generating unit 410, a downmix signal coding unit 404, a first t-f converting unit 401, an SAC analyzing unit 402, a second t-f converting unit 405, a downmix compensation circuit 406, and a multiplexing device 407. The downmix signal generating unit 410 includes an arbitrary downmix circuit 403. The SAC analyzing unit 402 includes a downmixing unit 408 and a spatial information calculating unit 409.

The arbitrary downmix circuit 403 arbitrarily downmixes an input multi-channel audio signal to one of a 1-channel audio signal and a 2-channel audio signal to generate an arbitrary downmix signal ADMX.

The downmix signal coding unit 404 codes the arbitrary downmix signal ADMX generated by the arbitrary downmix circuit 403.

The second t-f converting unit 405 converts the arbitrary downmix signal ADMX generated by the arbitrary downmix circuit 403 in a time domain into a signal in a frequency domain to generate an intermediate arbitrary downmix signal IADMX in the frequency domain.

The first t-f converting unit 401 converts the input multi-channel audio signal in the time domain into a signal in the frequency domain.

The downmixing unit 408 analyzes the multi-channel audio signal in the frequency domain obtained by the first t-f converting unit 401 to generate an intermediate downmix signal IDMX in the frequency domain.

The spatial information calculating unit 409 generates spatial information by analyzing the multi-channel audio signal that is obtained by the first t-f converting unit 401 and is in the frequency domain. The spatial information includes channel separation information that separates a downmix signal into signals included in a multi-channel audio signal. The channel separation information is information indicating relationships between a downmix signal and a multi-channel audio signal, such as correlation values, and power ratios, and differences between phases thereof.

The downmix compensation circuit 406 compares the intermediate arbitrary downmix signal IADMX and the intermediate downmix signal IDMX to calculate downmix compensation information (DMX cues).

The multiplexing device 407 is an example of a multiplexer including a mechanism for providing a single signal from two or more inputs. The multiplexing device 407 multiplexes, to a bit stream, the arbitrary downmix signal ADMX coded by the downmix signal coding unit 404, the spatial information calculated by the spatial information calculating unit 409, and the downmix compensation information calculated by the downmix compensation circuit 406.

As illustrated in FIG. 1, an input multi-channel audio signal is fed to 2 modules. One of the modules is the arbitrary downmix circuit 403, and the other is the first t-f converting unit 401. The t-f converting unit 401, for example, converts the input multi-channel audio signal into a signal in a frequency domain, using Equation 1.

$$S(f) = \sum_{k=0}^{N-1} s(t)\cos\left(\frac{\pi}{2N}\left(2k+1+\frac{N}{2}\right)(2f+1)\right) \quad \text{[Equation 1]}$$

Equation 1 is an example of a modified discrete cosine transform (MDCT). s(t) represents an input multi-channel audio signal in a time domain. S(f) represents a multi-channel audio signal in a frequency domain. t represents the time domain. f represents the frequency domain. N is the number of frames.

Although a MDCT is shown in Equation 1 as an example of an equation used by the first t-f converting unit 401, the present invention is not limited to Equation 1. There are cases where a signal is converted into a signal in a pure frequency domain using the Fast Fourier Transform (FFT) and the MDCT, and where a signal is converted into a combined frequency domain that is another frequency domain having a component in a time axis direction using e.g., the QMF bank. Thus, the first t-f converting unit 401 holds, in a coded stream, information indicating which transform domain is used. For example, the first t-f converting unit 401 holds "01" representing a combined frequency domain using the QMF bank and "00" representing a frequency domain using the MDCT, in respective coded streams.

The downmixing unit 408 in the SAC analyzing unit 402 downmixes the multi-channel audio signal converted into a signal in a frequency domain, to the intermediate downmix signal IDMX. The intermediate downmix signal IDMX is one of a 1-channel audio signal and a 2-channel audio signal, and is a signal in a frequency domain.

$$S_{IDMX}(f) = \begin{pmatrix} C_L & C_R & C_C & C_{Ls} & C_{Rs} \\ D_L & D_R & D_C & D_{Ls} & D_{Rs} \end{pmatrix} * \begin{pmatrix} S_L(f) \\ S_R(f) \\ S_C(f) \\ S_{Ls}(f) \\ S_{Rs}(f) \end{pmatrix} \quad \text{[Equation 2]}$$

Equation 2 is an example of a calculation of a downmix signal. f in Equation 2 represents a frequency domain. $S_L(f)$, $S_R(f)$, $S_C(f)$, $S_{Ls}(f)$, and $S_{Rs}(f)$ represent audio signals in each channel. $S_{IDMX}(f)$ represents the intermediate downmix signal IDMX. $C_L$, $C_R$, $C_C$, $C_{Ls}$, $C_{Rs}$, $D_L$, $D_R$, $D_C$, $D_{Ls}$, and $D_{Rs}$ represent downmix coefficients.

Here, the downmix coefficients to be used conform to the International Telecommunication Union (ITU) standard. Although a downmix coefficient in conformance with the ITU is generally used for calculating a signal in a time domain, the downmix coefficient is used for converting a signal in a frequency domain in Embodiment 1, which differs from the downmix technique according to the general ITU recommendation. There are cases where characteristics of a multi-channel audio signal may alter the downmix coefficient herein.

The spatial information calculating unit 409 in the SAC analyzing unit 402 calculates and quantizes spatial information, simultaneously when the downmixing unit 408 in the SAC analyzing unit 402 downmixes a signal. The spatial information is used when a downmix signal is separated into signals included in a multi-channel audio signal.

$$ILD_{n,m} = \frac{S(f)_n^2}{S(f)_m^2} \quad \text{[Equation 3]}$$

Equation 3 calculates a power ratio between a channel n and a channel m as an $ILD_{n,m}$. Values assigned to n and m include 1 corresponding to an L channel, 2 corresponding to an R channel, 3 corresponding to a C channel, 4 corresponding to an Ls channel, and 5 corresponding to an Rs channel. Furthermore, $S(f)_n$ and $S(f)_m$ represent audio signals in each channel.

Similarly, a correlation coefficient between the channel n and the channel m is calculated as $ICC_{n,m}$ as expressed in Equation 4.

$$ICC_{n,m} = Corr(S(f)_n, S(f)_m) \quad \text{[Equation 4]}$$

Values assigned to n and m include 1 corresponding to the L channel, 2 corresponding to the R channel, 3 corresponding to the C channel, 4 corresponding to the Ls channel, and 5 corresponding to the Rs channel. Furthermore, $S(f)_n$ and $S(f)_m$ represent audio signals in each channel. Furthermore, an operator Corr is expressed by Equation 5.

$$Corr(x, y) = \frac{\sum_i (x_i - \bar{x})(y_i - \bar{y})}{\sqrt{\sum_i (x_i - \bar{x})^2} * \sqrt{\sum_i (y_i - \bar{y})^2}} \quad \text{[Equation 5]}$$

$x_i$ and $y_i$ in Equation 5 respectively represent each element included in x and y to be calculated using the operator Corr. Each of x bar and y bar indicates an average value of elements included in x and y to be calculated.

As such, the spatial information calculating unit 409 in the SAC analyzing unit 402 calculates an ILD and an ICC between channels, quantizes the ILD and the ICC, and eliminates redundancies thereof using e.g., the Huffman coding method as necessary to generate spatial information.

Figure 2:
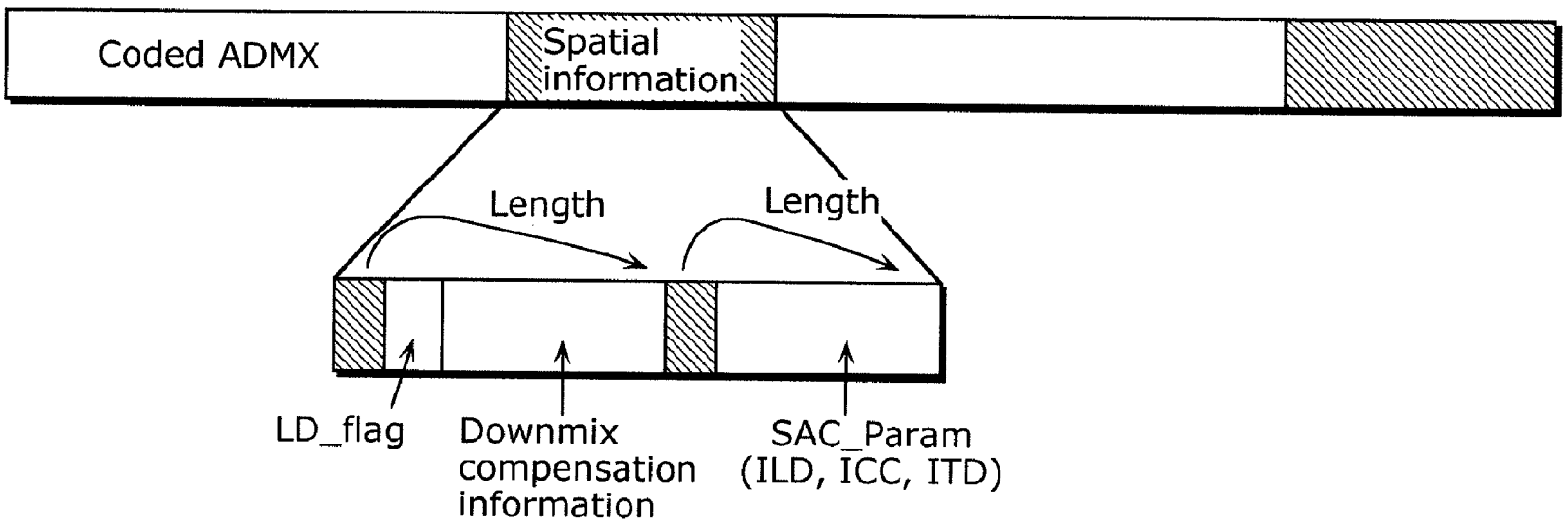
FIG. 2 illustrates a structure of a bit stream according to an embodiment in the present invention.

The multiplexing device 407 multiplexes the spatial information generated by the spatial information calculating unit 409 to a bit stream as illustrated in FIG. 2.

FIG. 2 illustrates a structure of a bit stream according to Embodiment 1 in the present invention. The multiplexing device 407 multiplexes the coded arbitrary downmix signal ADMX and the spatial information to a bit stream. Furthermore, the spatial information includes information SAC_Param calculated by the spatial information calculating unit 409 and the downmix compensation information calculated by the downmix compensation circuit 406. Inclusion of the downmix compensation information in the spatial information can maintain compatibility with a conventional audio decoding apparatus.

Furthermore, LD_flag (a low delay flag) in FIG. 2 is a flag indicating whether or not a signal is coded by the audio coding method according to an implementation of the present invention. The multiplexing device 407 in the audio coding apparatus adds LD_flag so that the audio decoding apparatus can easily determine whether a signal is added with the downmix compensation information. Furthermore, the audio decoding apparatus may perform decoding that results in lower delay by skipping the added downmix compensation information.

Although a power ratio and a correlation coefficient between channels of an input multi-channel audio signal are used as spatial information in Embodiment 1, the present invention is not limited to such, and the spatial information may be a coherence between input multi-channel audio signals and a difference between absolute values.

Furthermore, NPL 1 describes the details of employing the MPEG surround standard as the SAC standard. The Interaural Correlation Coefficient (ICC) in NPL 1 corresponds to correlation information between channels, whereas Interaural Level Difference (ILD) corresponds to a power ratio between channels. Interaural Time Difference (ITD) in FIG. 2 corresponds to information of a time difference between channels.

Next, functions of the arbitrary downmix circuit 403 will be described.

The arbitrary downmix circuit 403 arbitrarily downmixes a multi-channel audio signal in a time domain to calculate the arbitrary downmix signal ADMX that is one of a 1-channel audio signal and a 2-channel audio signal in the time domain. The downmix processes are, for example, in accordance with ITU Recommendation BS.775-1 (Non Patent Literature 5).

$$S_{ADMX}(t) = \begin{pmatrix} C_L & C_R & C_C & C_{Ls} & C_{Rs} \\ D_L & D_R & D_C & D_{Ls} & D_{Rs} \end{pmatrix} * \begin{pmatrix} s(t)_L \\ s(t)_R \\ s(t)_C \\ s(t)_{Ls} \\ s(t)_{Rs} \end{pmatrix} \quad \text{[Equation 6]}$$

Figure 3:
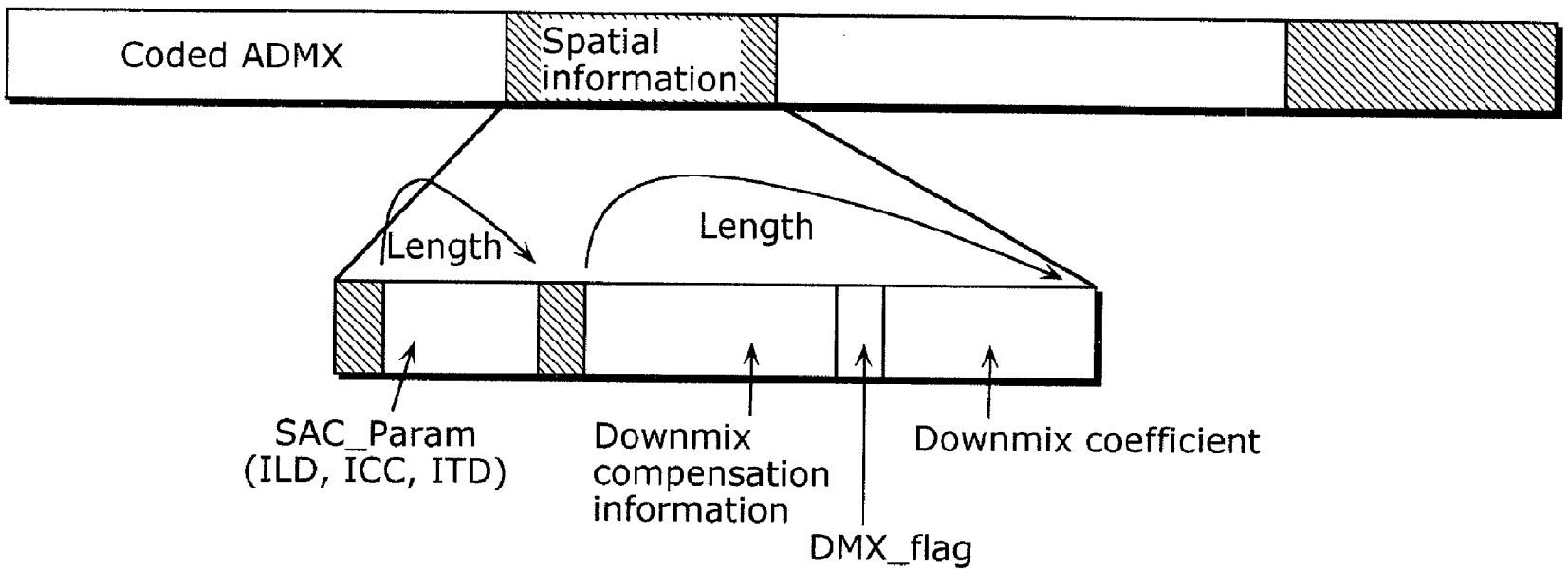
FIG. 3 illustrates a structure of another bit stream according to an embodiment in the present invention.

Equation 6 is an example of a calculation of a downmix signal. t in Equation 6 represents a time domain. Furthermore, $s(t)_L$, $s(t)_R$, $s(t)_C$, $s(t)_{Ls}$ and $s(t)_{Rs}$ represent audio signals in each channel. $S_{ADMX}$ (t) represents the arbitrary downmix signal ADMX. $C_L$, $C_R$, $C_C$, $C_{Ls}$, $C_{Rs}$, $D_L$, $D_R$, $D_C$, $D_{Ls}$, and $D_{Rs}$ represent downmix coefficients. According to an implementation of the present invention, the multiplexing device 407 may transmit a downmix coefficient assigned to each of the audio coding apparatuses as part of a bit stream as illustrated in FIG. 3. Furthermore, with provision of sets of downmix coefficients, the multiplexing device 407 may multiplex, to a bit stream, information for switching between the downmix coefficients, and transmit the bit stream.

FIG. 3 illustrates a structure of a bit stream that is different from the bit stream in FIG. 2, according to Embodiment 1 in the present invention. The bit stream in FIG. 3 is a bit stream in which the coded arbitrary downmix signal ADMX and the spatial information are multiplexed, as the bit stream in FIG. 2. Furthermore, the spatial information includes information SAC_Param calculated by the spatial information calculating unit 409 and the downmix compensation information calculated by the downmix compensation circuit 406. The bit stream in FIG. 3 further includes information DMX_flag indicating information of a downmix coefficient and a pattern of the downmix coefficient.

For example, 2 patterns of downmix coefficients are provided. One of the patterns is a coefficient in accordance with the ITU recommendation, and the other is a coefficient defined by the user. The multiplexing device 407 describes 1 bit of additional information in a bit stream, and transmits the 1 bit information as "0" in accordance with the ITU recommendation. When a coefficient is defined by the user, the multiplexing device 407 transmits the 1 bit information as "1", and holds the coefficient defined by the user in a position subsequent to "1" in the case where the 1 bit information is represented by "1". For example, when the arbitrary downmix signal ADMX is monaural, the bit stream holds a length of the downmix coefficient (when the original signal is a 5.1 channel signal, the multiplexing device 407 holds "6"). Subsequently, the actual downmix coefficient is held as a fixed number of bits. When the original signal is a 5.1 channel signal and is 16-bit wide, a total 96-bit downmix coefficient is described in the bit stream. When the arbitrary downmix signal ADMX is stereo, the bit stream holds a length of the downmix coefficient (when the original signal is a 5.1 channel signal, the multiplexing device 407 holds "12"). Subsequently, the actual downmix coefficient is held as a fixed number of bits.

The downmix coefficient may be held as a fixed number of bits and as a variable number of bits. In such a case, the information indicating the length of bits held for the downmix coefficient is stored in a bit stream.

The audio decoding apparatus holds pattern information of downmix coefficients. Only reading the pattern information, the audio decoding apparatus can decode signals without redundant processing, such as reading the downmix coefficient itself. No redundant processing brings an advantage of decoding with lower power consumption.

The arbitrary downmix circuit 403 downmixes a signal in such a manner. Then, the downmix signal coding unit 404 codes the arbitrary downmix signal ADMX of one of 1-channel and 2-channel at a predetermined bit rate and in accordance with a predetermined coding standard. Furthermore, the multiplexing device 407 multiplexes the coded signal to a bit stream, and transmits the bit stream to the audio decoding apparatus.

On the other hand, the second t-f converting unit 405 converts the arbitrary downmix signal ADMX into a signal in a frequency domain to generate the intermediate arbitrary downmix signal IADMX.

$$S_{IADMX}(f) = \sum_{k=0}^{N-1} S_{ADMX}(t)\cos\left(\frac{\pi}{2N}\left(2k+1+\frac{N}{2}\right)(2f+1)\right) \quad \text{[Equation 7]}$$

Equation 7 is an example of a MDCT to be used for converting a signal into a signal in a frequency domain. t in Equation 7 represents a time domain. f represents a frequency domain. N is the number of frames. $S_{ADMX}$ (f) represents the arbitrary downmix signal ADMX. $S_{IADMX}$(f) represents the intermediate arbitrary downmix signal IADMX.

The conversion employed in the second t-f converting unit 405 may be the MDCT expressed in Equation 7, the FFT, and the QMF bank.

Although the second t-f converting unit 405 and the first t-f converting unit 401 desirably perform the same type of a conversion, different types of conversions may be used when it is determined that coding and decoding may be simplified using the different types of conversions (for example, a combination of the FFT and the QMF bank and a combination of the FFT and the MDCT). The audio coding apparatus holds, in a bit stream, information indicating whether t-f conversions are of the same type or of different types, and information which conversion is used when the different types of t-f conversions are used. The audio decoding apparatus implements decoding based on such information.

The downmix signal coding unit 404 codes the arbitrary downmix signal ADMX. The MPEG-AAC standard described in NPL 1 is employed as the coding standard herein. Since the coding standard in the downmix signal coding unit 404 is not limited to the MPEG-AAC standard, the standard may be a lossy coding standard, such as the MP3 standard, and a lossless coding standard, such as the MPEG-ALS standard. When the coding standard in the downmix signal coding unit 404 is the MPEG-AAC standard, the audio coding apparatus has 2048 samples as the delay amount (the audio decoding apparatus has 1024 samples).

The coding standard of the downmix signal coding unit 404 according to an implementation of the present invention has no particular restriction on the bit rate, and is more suitable to be used as the orthogonal transformation, such as the MDCT and FFT.

$S_{IADMX}(f)$ and $S_{IDMX}(f)$ that can be calculated in parallel are calculated in parallel. Thus, the total delay amount in the audio coding apparatus can be reduced from D0+D1+D2+D3 to max (D0+D1, D3). In particular, the audio coding apparatus according to an implementation of the present invention reduces the total delay amount through downmix coding in parallel with the SAC analysis.

The audio decoding apparatus according to an implementation of the present invention can reduce an amount of t-f converting processing before the SAC synthesis unit 505 generates a multi-channel audio signal, and reduce the delay amount from D4+D0+D5+D2 to D5+D2 by intermediately performing downmix decoding.

Next, the audio decoding apparatus will be described.

Figure 4:
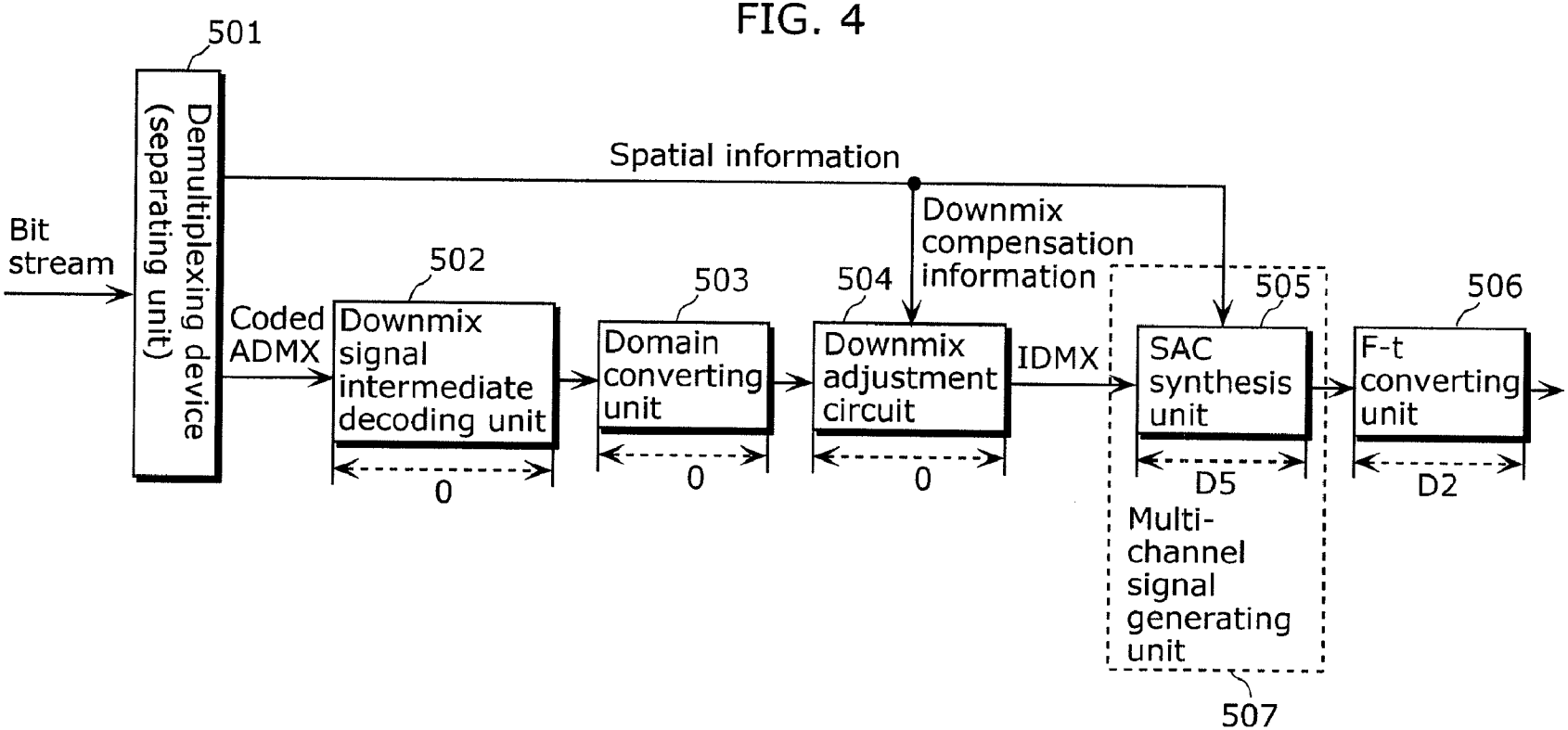
FIG. 4 illustrates a configuration of an audio decoding apparatus and a delay amount in each constituent element according to an embodiment in the present invention.

FIG. 4 illustrates an example of an audio decoding apparatus according to Embodiment 1 in the present invention. Furthermore, a delay amount is shown under each constituent element in FIG. 4. The delay amount corresponds to a time period between storage of input signals and output signals as shown in FIG. 1. Furthermore, when no plural signals is stored between an input and an output, the delay amount that is negligible is denoted as "0" in FIG. 4, as shown in FIG. 1.

The audio decoding apparatus in FIG. 4 is an audio decoding apparatus that decodes a received bit stream into a multi-channel audio signal.

Furthermore, the audio decoding apparatus in FIG. 4 includes: a demultiplexing device 501 that separates the received bit stream into a data portion and a parameter portion; a downmix signal intermediate decoding unit 502 that dequantizes a coded stream in the data portion and calculates a signal in a frequency domain; a domain converting unit 503 that converts the calculated signal in the frequency domain into another signal in the frequency domain as necessary; a downmix adjustment circuit 504 that adjusts the signal converted into the signal in the frequency domain, using downmix compensation information included in the parameter portion; a multi-channel signal generating unit 507 that generates a multi-channel audio signal from the signal adjusted by the downmix adjustment circuit 504 and spatial information included in the parameter portion; and an f-t converting unit 506 that converts the generated multi-channel audio signal into a signal in a time domain.

Furthermore, the multi-channel signal generating unit 507 includes an SAC synthesis unit 505 that generates a multi-channel audio signal in accordance with the SAC standard.

The demultiplexing device 501 is an example of a demultiplexer that provides signals from a single input signal, and is an example of a separating unit that separates the single signal into the signals. The demultiplexing device 501 separates the bit stream generated by the audio coding apparatus illustrated in FIG. 1 into a downmix coded stream and spatial information.

The demultiplexing device 501 separates the bit stream using length information of (i) the downmix coded stream and (ii) a coded stream of the spatial information. Here, (i) and (ii) are included in the bit stream.

The downmix signal intermediate decoding unit 502 generates a signal in a frequency domain by dequantizing the downmix coded stream separated by the demultiplexing device 501. No delay circuit is present in these processes, and thus no delay occurs. The downmix signal intermediate decoding unit 502 calculates a coefficient in a frequency domain in accordance with the MPEG-AAC standard (a MDCT coefficient in accordance with the MPEG-AAC standard) through processing upstream a filter bank described in FIG. 0.2-MPEG-2 AAC Decoder Block Diagram included in NPL 1, for example. In other words, the audio decoding apparatus according to an implementation of the present invention differs from the conventional audio decoding apparatus in decoding without any process in the filter bank. Although a delay occurs in a delay circuit included in the filter bank in the conventional audio decoding apparatus, the downmix signal intermediate decoding unit 502 according to an implementation of the present invention does not need a filter bank, and thus no delay occurs.

The domain converting unit 503 converts the signal that is in the frequency domain and is obtained through downmix intermediate decoding by the downmix signal intermediate decoding unit 502, into a signal in another frequency domain for adjusting a downmix signal as necessary.

More specifically, the domain converting unit 503 performs conversion to a domain in which downmix compensation is performed, using downmix compensation domain information that indicates a frequency domain and is included in the coded stream. The downmix compensation domain information is information indicating in which domain the downmix compensation is performed. For example, the audio coding apparatus codes, as the downmix compensation domain information, "01" in a QMF bank, "00" in an MDCT domain, and "10" in an FFT domain, and the domain converting unit 503 determines which domain the downmix compensation is performed by receiving the downmix compensation domain information.

Next, the downmix adjustment circuit 504 adjusts a downmix signal obtained by the domain converting unit 503 using the downmix compensation information calculated by the audio coding apparatus. In other words, the downmix adjustment circuit 504 calculates an approximate value of a frequency domain coefficient of the intermediate downmix signal IDMX. The adjustment method that depends on the coding standard of the downmix compensation information will be described later.

The SAC synthesis unit 505 separates the intermediate downmix signal IDMX adjusted by the downmix adjustment circuit 504 using e.g., the ICC and the ILD included in the spatial information, into a multi-channel audio signal in a frequency domain.

The f-t converting unit 506 converts the resulting signal into a multi-channel audio signal in a time domain, and reproduces the multi-channel audio signal. Here, the f-t converting unit 506 uses a filter bank, such as Inverse Modified Discrete Cosine Transform (IMDCT).

NPL 1 describes the details of employing the MPEG surround standard as the SAC standard in the SAC synthesis unit 505.

In the audio decoding apparatus having such a configuration, a delay occurs in the SAC synthesis unit 505 and the f-t converting unit 506 each including a delay circuit. The delay amounts are respectively denoted as D5 and D2.

Figure 9:
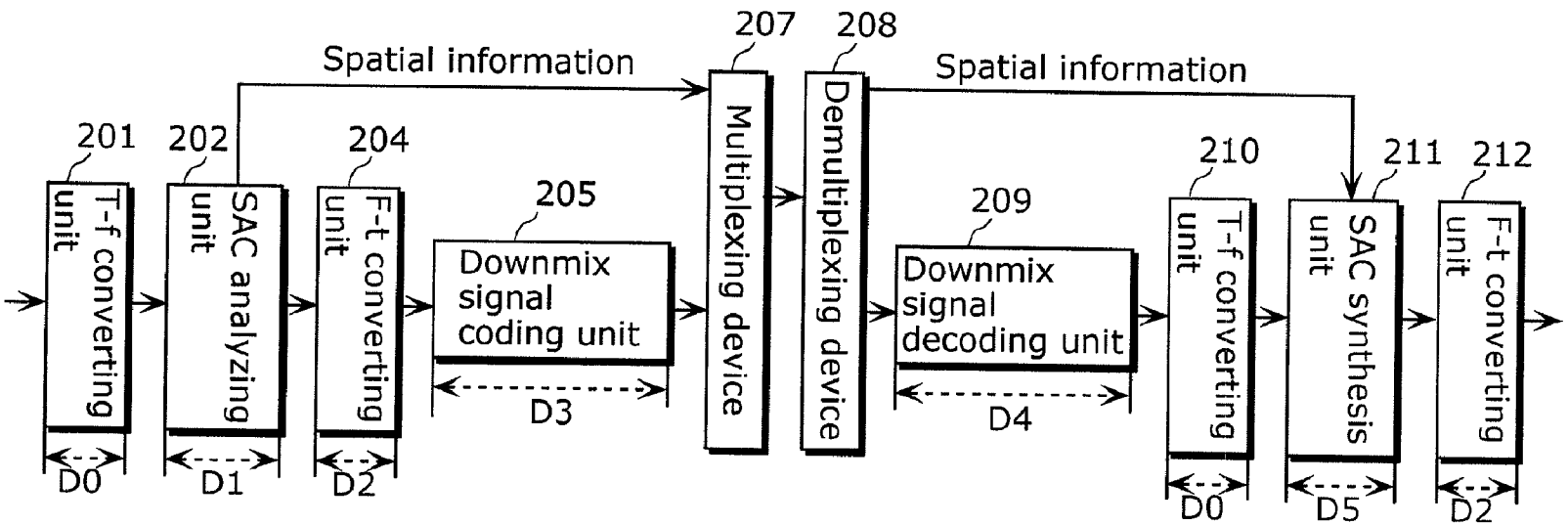
PRIOR ART FIG. 9
FIG. 9 illustrates a configuration of conventional audio coding and decoding apparatuses.

Comparison between the conventional SAC decoding apparatus in FIG. 9 and the audio decoding apparatus according to an implementation of the present invention (FIG. 4) clarifies the differences in the configurations. As illustrated in FIG. 9, the downmix signal decoding unit 209 in the conventional SAC decoding apparatus includes an f-t converting unit which causes a delay of D4 samples. Furthermore, since the SAC synthesis unit 211 calculates a signal in a frequency domain, it needs the t-f converting unit 210 that converts an output of the downmix signal decoding unit 209 temporarily into a signal in a frequency domain, and the conversion causes a delay of D0 samples. Thus, the total delay in the audio decoding apparatus amounts to D4+D0+D5+D2 samples.

On the other hand, in FIG. 4 according to an implementation of the present invention, the total delay amount is obtained by adding D5 samples that is a delay amount in the SAC synthesis unit 505 and D2 samples that is a delay amount in the f-t converting unit 506. Thus, compared to the conventional example in FIG. 9, the audio decoding apparatus reduces a delay of D4+D0 samples.

Next, operations of the downmix compensation circuit 406 and the downmix adjustment circuit 504 will be described.

First, the significance of the downmix compensation circuit 406 in Embodiment 1 will be described by pointing out the problems in the prior art.

Figure 8:
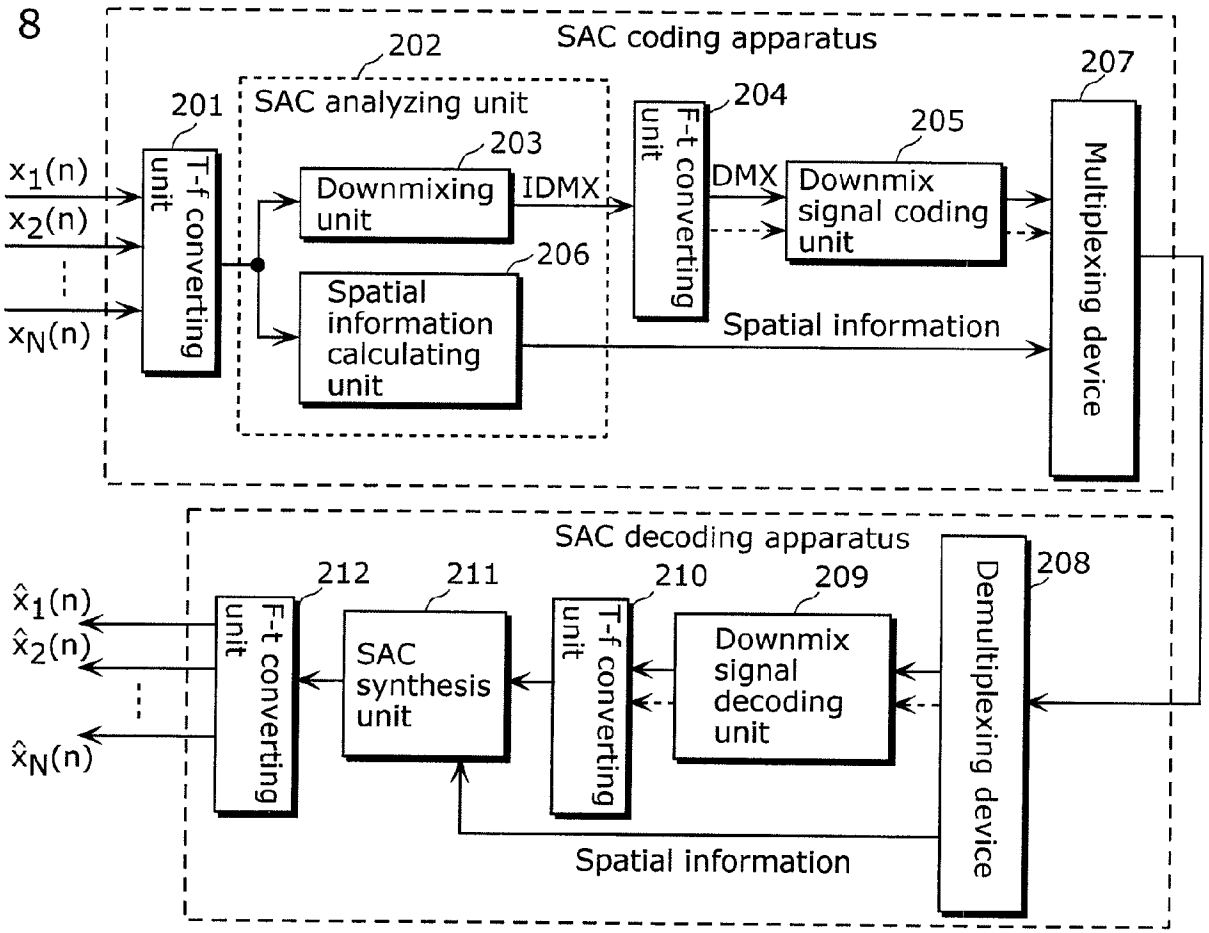
PRIOR ART FIG. 8
FIG. 8 illustrates a configuration of conventional audio coding and decoding apparatuses.

FIG. 8 illustrates a configuration of a conventional SAC coding apparatus.

The downmixing unit 203 downmixes a multi-channel audio signal in a frequency domain to the intermediate downmix signal IDMX that is one of a 1-channel audio signal and a 2-channel audio signal in the frequency domain. The downmix method includes a method recommended by the ITU. The f-t converting unit 204 converts the intermediate downmix signal IDMX that is one of the 1-channel audio signal and the 2-channel audio signal in the frequency domain into a downmix signal DMX that is one of a 1-channel audio signal and a 2-channel audio signal in a time domain.

The downmix signal coding unit 205 codes the downmix signal DMX, for example, in accordance with the MPEG-AAC standard. Here, the downmix signal coding unit 205 performs an orthogonal transformation from the time domain to a frequency domain. Thus, the conversion between the time domain and the frequency domain in the f-t converting unit 204 and the downmix signal coding unit 205 causes an enormous delay.

Thus, focusing on a feature that the downmix signal that is in the frequency domain and is generated by the downmix signal coding unit 205 is of the same type as that of the intermediate downmix signal IDMX generated by the SAC analyzing unit 202, the f-t converting unit 204 is eliminated from the SAC coding apparatus. Then, the arbitrary downmix circuit 403 illustrated in FIG. 1 is provided as a circuit for downmixing a multi-channel audio signal to one of a 1-channel audio signal and a 2-channel audio signal, in a time domain. Furthermore, the second t-f converting unit 405 is provided for performing the same processing as conversion in the downmix signal coding unit 205 from a time domain to a frequency domain.

Here, there is a difference between (i) the original downmix signal DMX obtained by converting the intermediate downmix signal IDMX in a frequency domain into the downmix signal in a time domain using the f-t converting unit 204 in FIG. 8 and (ii) the intermediate arbitrary downmix signal IADMX which is one of a 1-channel audio signal and a 2-channel audio signal that is in the time domain and is obtained by the arbitrary downmix circuit 403 and the second t-f converting unit 405 in FIG. 1. Thus, the difference causes degradation in sound quality.

Thus, the downmix compensation circuit 406 is provided as a circuit for compensating the difference in Embodiment 1. Thus, the degradation in sound quality is prevented. Furthermore, the downmix compensation circuit 406 can reduce the delay amount in the conversion by the f-t converting unit 204 from the frequency domain to the time domain.

Next, the configuration of the downmix compensation circuit 406 according to Embodiment 1 will be described. The assumption herein is that M frequency domain coefficients can be calculated in each of coding frames and decoding frames.

The SAC analyzing unit 402 downmixes a multi-channel audio signal in a frequency domain to the intermediate downmix signal IDMX. The frequency domain coefficient corresponding to the intermediate downmix signal IDMX is expressed as x(n)(n=0,1, . . . , M−1).

On the other hand, the second t-f converting unit 405 converts the arbitrary downmix signal ADMX generated by the arbitrary downmix circuit 403 into the intermediate arbitrary downmix signal IADMX that is a signal in a frequency domain. The frequency domain coefficient corresponding to the intermediate arbitrary downmix signal IADMX is expressed as y(n)(n=0, 1, . . . , M−1).

The downmix compensation circuit 406 calculates the downmix compensation information using the intermediate downmix signal IDMX and the intermediate arbitrary downmix signal IADMX. The calculation processes of the downmix compensation circuit 406 according to Embodiment 1 are as follows.

When a frequency domain is a pure frequency domain, a frequency resolution that is relatively imprecise is given to cue information that is the spatial information and the downmix compensation information. Sets of frequency domain coefficients grouped according to each frequency resolution are referred to as parameter sets. Each of the parameter sets usually includes at least one frequency domain coefficient. All representations of downmix compensation information are assumed to be determined according to the same structure as that of the spatial information in the present invention in order to simplify the combinations of the spatial information. Obviously, the downmix compensation information and the spatial information may be structured differently.

The downmix compensation information calculated by scaling is expressed as Equation 8.

$$G_{lev,i} = \frac{\sum_{n \in ps_i} x^2(n)}{\sum_{n \in ps_i} y^2(n)} \text{ for } i = 0, 1, \ldots, N-1 \quad \text{[Equation 8]}$$

Here, $G_{lev,i}$ represents downmix compensation information indicating a power ratio between the intermediate downmix signal IDMX and the intermediate arbitrary downmix signal IADMX. x(n) is a frequency domain coefficient of the intermediate downmix signal IDMX. y(n) is a frequency domain coefficient of the intermediate arbitrary downmix signal IADMX. $ps_i$ represents each parameter set, and is more specifically a subset of a set {0,1, . . . , M−1}. N represents the number of subsets obtained by dividing the set {0,1, . . . , M−1} having M elements, and represents the number of parameter sets.

Figure 5:
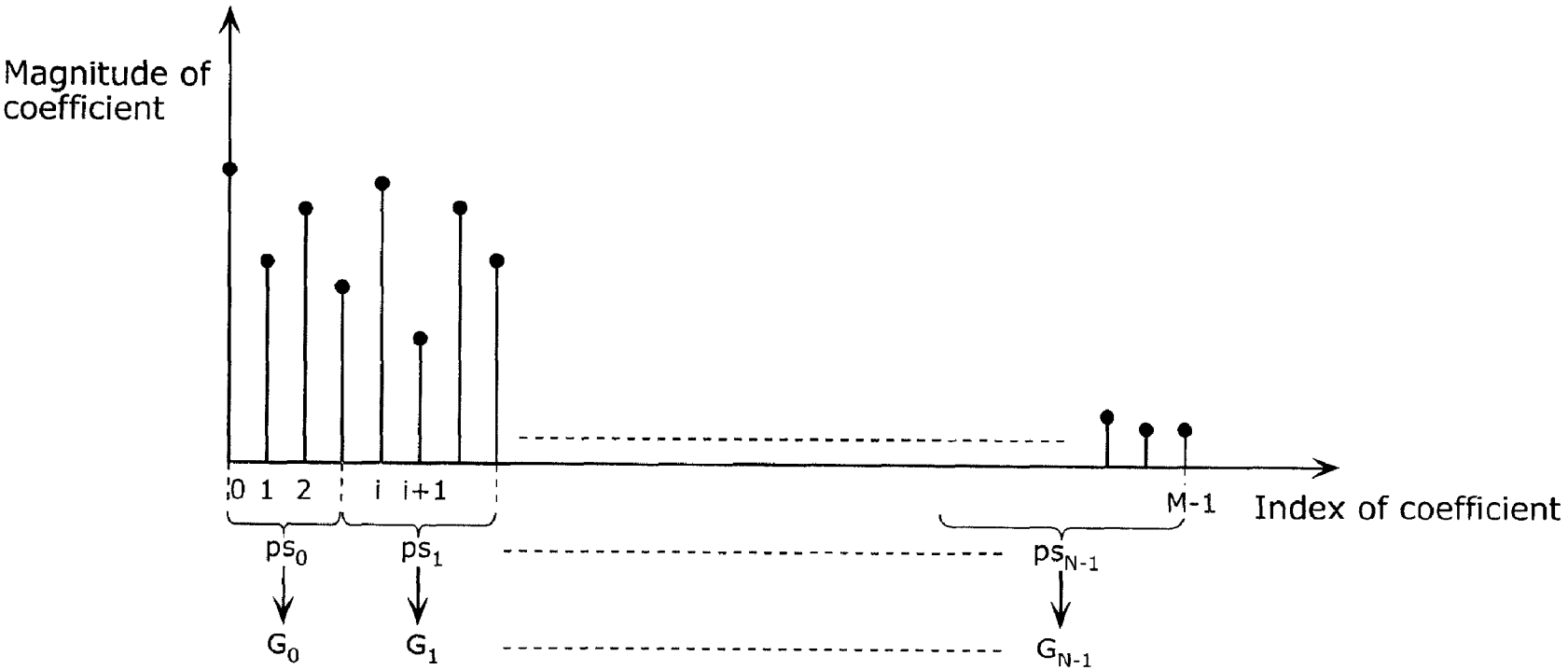
FIG. 5 illustrates parameter sets according to an embodiment in the present invention.

In other words, as illustrated in FIG. 5, the downmix compensation circuit 406 calculates $G_{lev,i}$ that represents N pieces of downmix compensation information, using x(n) and y(n) each of which represents M frequency domain coefficients.

The calculated $G_{lev,i}$ is quantized, and is multiplexed to a bit stream by eliminating the redundancies using the Huffman coding method as necessary.

The audio decoding apparatus receives the bit stream, and calculates an approximate value of a frequency domain coefficient of the intermediate downmix signal IDMX, using (i) y(n) that is a frequency domain coefficient of the decoded intermediate arbitrary downmix signal IADMX and (ii) the received $G_{lev,i}$ that represents the downmix compensation information.

$$\hat{x}(n)=y(n)\sqrt{G_{lev,i}} \text{ for } n\epsilon ps_i \text{ and } i=0,1,\ldots,N-1 \quad \text{[Equation 9]}$$

Here, the left part of Equation 9 represents an approximate value of a frequency domain coefficient of the intermediate downmix signal IDMX. $ps_i$ represents each parameter set. N represents the number of the parameter sets.

The downmix adjustment circuit 504 of the audio decoding apparatus in FIG. 4 performs calculation in Equation 9. As such, the audio decoding apparatus calculates the approximate value of the frequency domain coefficient of the intermediate downmix signal IDMX (left part of Equation 9), using (i) y(n) that is a frequency domain coefficient of the intermediate arbitrary downmix signal IADMX obtained from a bit stream and (ii) $G_{lev,i}$ that represents the downmix compensation information. The SAC synthesis unit 505 generates a multi-channel audio signal from the approximate value of the frequency domain coefficient of the intermediate downmix signal IDMX. The f-t converting unit 506 converts the multi-channel audio signal in a frequency domain into a multi-channel audio signal in a time domain.

The audio decoding apparatus according to Embodiment 1 implements efficient decoding using $G_{lev,i}$ that represents the downmix compensation information for each parameter set.

The audio decoding apparatus reads LD_flag in FIG. 2, and when LD_flag indicates the downmix compensation information added with LD_flag, the downmix compensation information may be skipped. The skipping may cause degradation in sound quality, but can lead to decoding a signal with lower delay.

The audio coding apparatus and the audio decoding apparatus having the aforementioned configurations (1) parallelize a part of the calculation processes, (2) share a part of the filter bank, and (3) newly add a circuit for compensating the sound degradation caused by (1) and (2) and transmit auxiliary information for compensating the sound degradation as a bit stream. The configurations make it possible to reduce the algorithm delay amount in half than that by the SAC standard represented by the MPEG surround standard that enables transmission of a signal with higher sound quality at an extremely lower bit rate but with higher delay, and to guarantee sound quality equivalent to that of the SAC standard.

(Embodiment 2)

Hereinafter, a downmix compensation circuit and a downmix adjustment circuit according to Embodiment 2 in the present invention will be described with reference to the drawings.

Although the base configurations of an audio coding apparatus and an audio decoding apparatus according to Embodiment 2 are the same as those of the audio coding apparatus and the audio decoding apparatus according to Embodiment 1 that are shown in FIGS. 1 and 4, operations of the downmix compensation circuit 406 are different in Embodiment 2, which will be described in detail hereinafter.

The operations of the downmix compensation circuit 406 according to Embodiment 2 will be described.

First, the significance of the downmix compensation circuit 406 in Embodiment 2 will be described by pointing out the problems in the prior art.

FIG. 8 illustrates a configuration of a conventional SAC coding apparatus.

The downmixing unit 203 downmixes a multi-channel audio signal in a frequency domain to an intermediate downmix signal IDMX that is one of a 1-channel audio signal and a 2-channel audio signal in the frequency domain. The downmix method includes a method recommended by the ITU. The f-t converting unit 204 converts the intermediate downmix signal IDMX that is one of the 1-channel audio signal and the 2-channel audio signal in the frequency domain into a downmix signal DMX that is one of a 1-channel audio signal and a 2-channel audio signal in a time domain.

The downmix signal coding unit 205 codes the downmix signal DMX, for example, in accordance with the MPEG-AAC standard. Here, the downmix signal coding unit 205 performs an orthogonal transformation from the time domain to a frequency domain. Thus, the conversion between the time domain and the frequency domain by the f-t converting unit 204 and the downmix signal coding unit 205 causes an enormous delay.

Thus, focusing on a feature that the downmix signal in the frequency domain that is generated by the downmix signal coding unit 205 is of the same type as that of the intermediate downmix signal IDMX generated by the SAC analyzing unit 202, the f-t converting unit 204 is eliminated from the SAC coding apparatus. Then, the arbitrary downmix circuit 403 illustrated in FIG. 1 is provided as a circuit for downmixing a multi-channel audio signal to one of a 1-channel audio signal and a 2-channel audio signal, in a time domain. Furthermore, the second t-f converting unit 405 is provided for performing the same processing as conversion in the downmix signal coding unit 205 from a time domain to a frequency domain.

Here, there is a difference between (i) the original downmix signal DMX obtained by converting the intermediate downmix signal IDMX in a frequency domain into the downmix signal in a time domain using the f-t converting unit 204 in FIG. 8 and (ii) the intermediate arbitrary downmix signal IADMX that is one of a 1-channel audio signal and a 2-channel audio signal in the time domain obtained by the arbitrary downmix circuit 403 and the second t-f converting unit 405 in FIG. 1. Thus, the difference causes degradation in sound quality.

Thus, the downmix compensation circuit 406 is provided as a circuit for compensating the difference in Embodiment 2. Thus, the degradation in sound quality is prevented. Furthermore, the downmix compensation circuit 406 can reduce the delay amount in the conversion by the f-t converting unit 204 from the frequency domain to the time domain.

Next, the configuration of the downmix compensation circuit 406 according to Embodiment 2 will be described. The assumption herein is that M frequency domain coefficients can be calculated in each of coding frames and decoding frames.

The SAC analyzing unit 402 downmixes a multi-channel audio signal in a frequency domain to the intermediate downmix signal IDMX. The frequency domain coefficients corresponding to the intermediate downmix signal IDMX is expressed as x(n)(n=0,1, . . . , M−1).

On the other hand, the second t-f converting unit 405 converts the arbitrary downmix signal ADMX generated by the arbitrary downmix circuit 403 into the intermediate arbitrary downmix signal IADMX that is a signal in a frequency domain. The frequency domain coefficient corresponding to the intermediate arbitrary downmix signal IADMX is expressed as y(n)(n=0,1, . . . , M−1).

The downmix compensation circuit 406 calculates the downmix compensation information using the intermediate downmix signal IDMX and the intermediate arbitrary downmix signal IADMX. The calculation processes of the downmix compensation circuit 406 according to Embodiment 2 are as follows.

When a frequency domain is a pure frequency domain, a frequency resolution that is relatively imprecise is given to cue information that is the spatial information and the downmix compensation information. Sets of frequency domain coefficients grouped according to each frequency resolution are referred to as parameter sets. Each of the parameter sets usually includes at least one frequency domain coefficient. All representations of downmix compensation information are assumed to be determined according to the same structure as that of the spatial information in the present invention in order to simplify the combinations of the spatial information. Obviously, the downmix compensation information and the spatial information may be structured differently.

Figure 6:
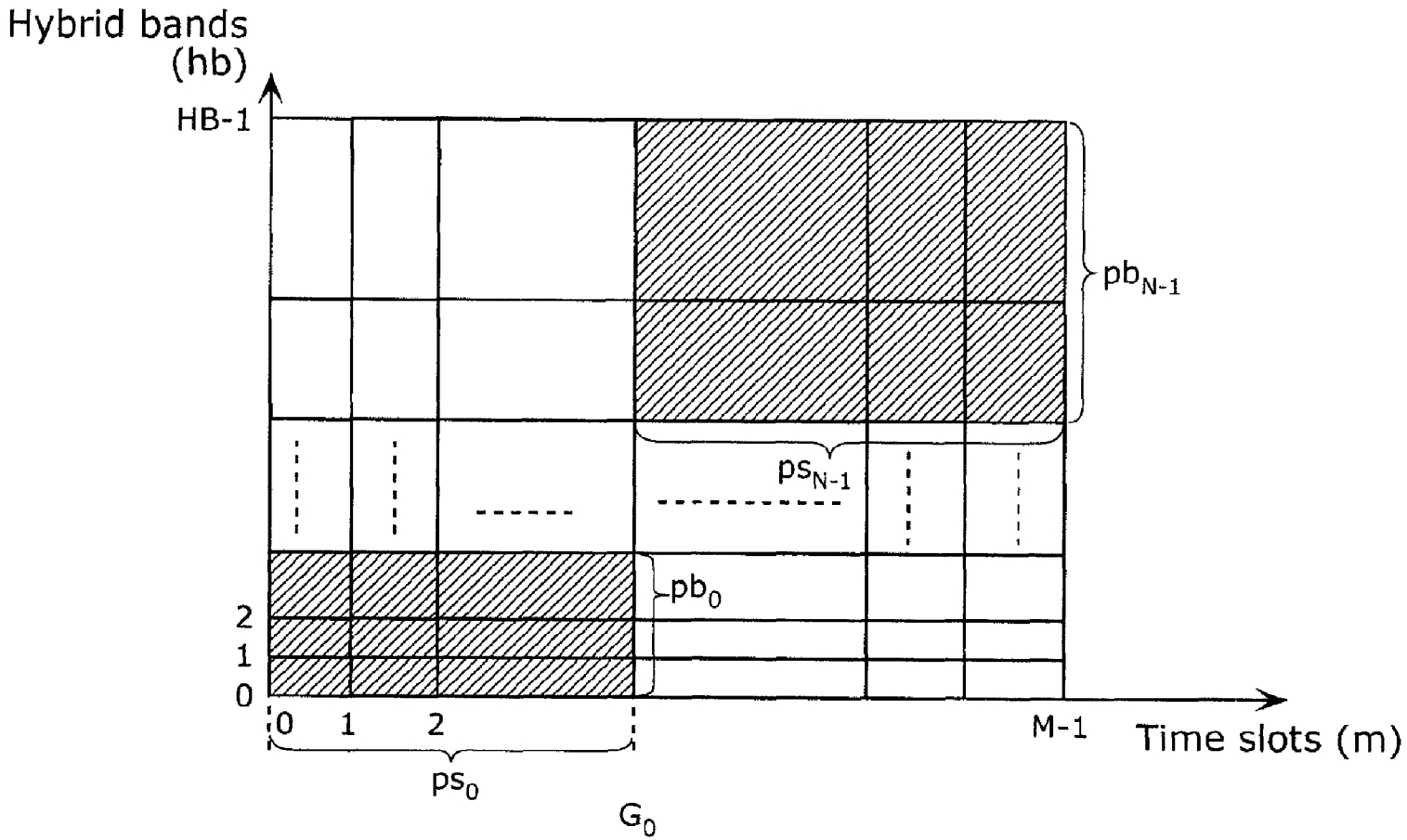
FIG. 6 illustrates a hybrid domain according to an embodiment in the present invention.
Figure 7:
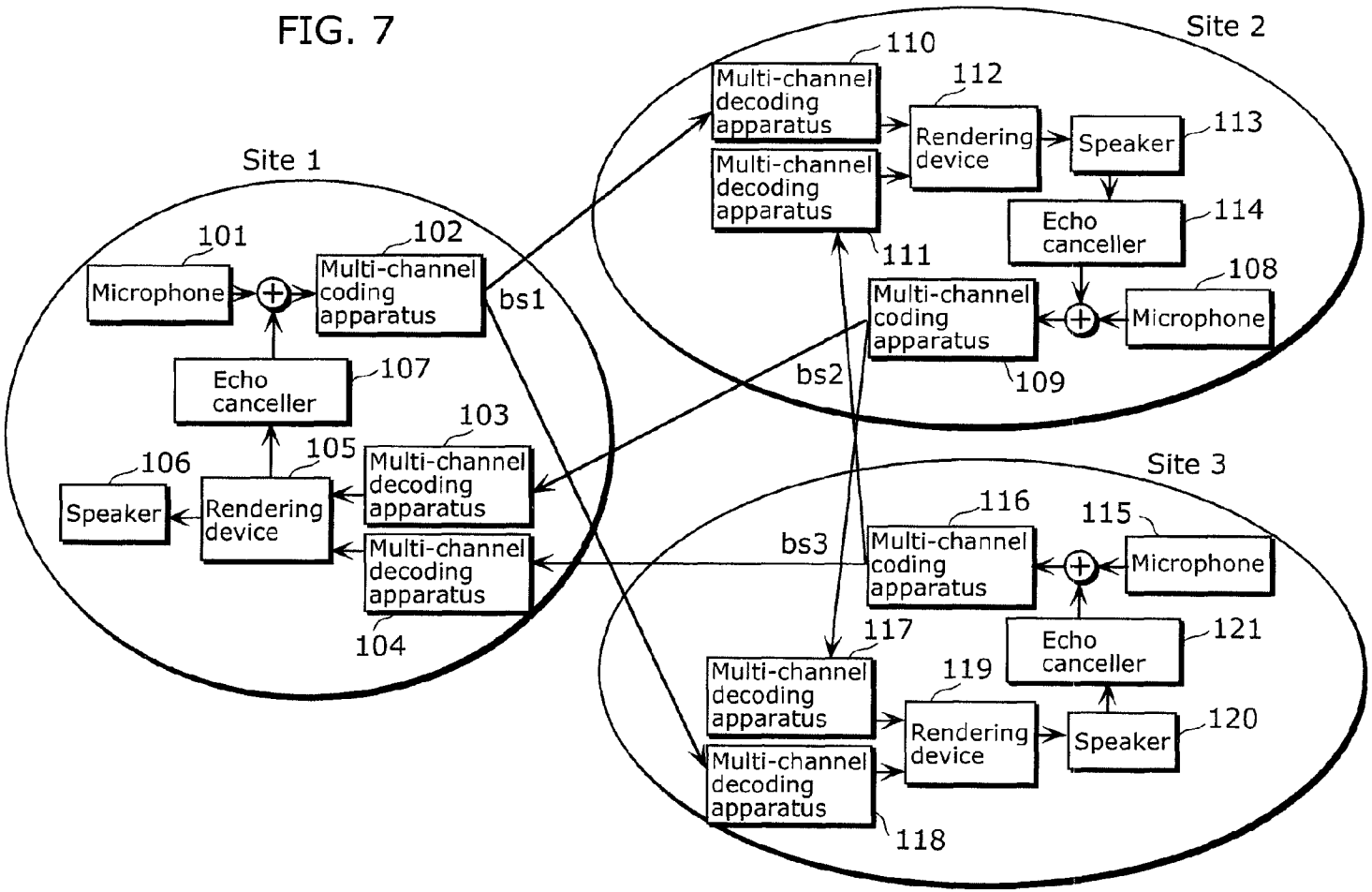
PRIOR ART FIG. 7
FIG. 7 illustrates a configuration of a conventional multi-site teleconferencing system.

When the MPEG surround standard is employed as the SAC standard, the QMF bank is used for conversion from a time domain to a frequency domain. As illustrated in FIG. 6, the conversion using the QMF bank results in a hybrid domain that is a frequency domain having a component in the time axis direction. x(n) that is a frequency domain coefficient of the intermediate downmix signal IDMX and y(n) that is a frequency domain coefficient of the intermediate arbitrary downmix signal IADMX are respectively expressed as x(m, hb) and y(m,hb)(m=0,1, . . . , M−1, hb=0,1, . . . , HB−1) that are expressions of the frequency domain coefficients obtained through temporal decomposition.

The spatial information is calculated based on a combined parameter (PS-PB) obtained from a parameter band and a parameter set. As illustrated in FIG. 6, each combined parameter (PS-PB) generally includes time slots and hybrid bands. In such a case, the downmix compensation circuit 406 calculates the downmix compensation information using Equation 10.

$$G_{lev,i} = \frac{\sum_{m \in ps_i, hb \in pb_i} x^2(m, hb)}{\sum_{m \in ps_i, hb \in pb_i} y^2(m, hb)} \text{ for } i = 0, 1, \ldots, N-1 \quad \text{[Equation 10]}$$

Here, $G_{lev,i}$ is downmix compensation information indicating a power ratio between the intermediate downmix signal IDMX and the intermediate arbitrary downmix signal IADMX. $ps_i$ represents each parameter set. $pb_i$ represents a parameter band. N represents the number of combined parameters (PS-PB). x(m,hb) represents a frequency domain coefficient of the intermediate downmix signal IDMX. y(m, hb) represents a frequency domain coefficient of the intermediate arbitrary downmix signal IADMX.

In other words, as in FIG. 6, the downmix compensation circuit 406 calculates $G_{lev,i}$ that is the downmix compensation information corresponding to the N combined parameters (PS-PB), using x(m,hb) and y(m,hb) that respectively represent M time slots and HB hybrid bands.

The multiplexing device 407 multiplexes the calculated downmix compensation information to a bit stream and transmits the bit stream.

Then, the downmix adjustment circuit 504 of the audio decoding apparatus in FIG. 4 calculates an approximate value of the frequency domain coefficient of the intermediate downmix signal IDMX using Equation 11.

$$\hat{x}(m,hb) = y(m,hb) \cdot \sqrt{G_{lev,i}} \text{ for } m \in ps_i,\ hb \in pb_i \text{ and } i = 0, 1, \ldots, N-1 \quad \text{[Equation 11]}$$

Here, the left part of Equation 11 represents the approximate value of the frequency domain coefficient of the intermediate downmix signal IDMX. Here, $G_{lev,i}$ is downmix compensation information indicating a power ratio between the intermediate downmix signal IDMX and the intermediate arbitrary downmix signal IADMX. $ps_i$ represents a parameter set. $pb_i$ represents a parameter band. N represents the number of combined parameters (PS-PB).

The downmix adjustment circuit 504 of the audio decoding apparatus in FIG. 4 performs calculation in Equation 11. As such, the audio decoding apparatus calculates the approximate value of the frequency domain coefficient of the intermediate downmix signal IDMX (left part of Equation 11), using (i) y(m,hb) that is a frequency domain coefficient of the intermediate arbitrary downmix signal IADMX obtained from a bit stream and (ii) $G_{lev}$ that represents the downmix compensation information. The SAC synthesis unit 505 generates a multi-channel audio signal from the approximate value of the frequency domain coefficient of the intermediate downmix signal IDMX. The f-t converting unit 506 converts the multi-channel audio signal in a frequency domain into a multi-channel audio signal in a time domain.

The audio decoding apparatus according to Embodiment 2 implements efficient decoding using $G_{lev,i}$ that represents the downmix compensation information for each of the combined parameters (PS-PB).

The audio coding apparatus and the audio decoding apparatus having the aforementioned configurations (1) parallelize a part of the calculation processes, (2) share a part of the filter bank, and (3) newly add a circuit for compensating the sound degradation caused by (1) and (2) and transmit auxiliary information for compensating the sound degradation as a bit stream. The configurations make it possible to reduce the algorithm delay amount in half than that by the SAC standard represented by the MPEG surround standard that enables transmission of a signal with higher sound quality at an extremely lower bit rate but with higher delay, and to guarantee sound quality equivalent to that of the SAC standard.

(Embodiment 3)

Hereinafter, a downmix compensation circuit and a downmix adjustment circuit according to Embodiment 3 in the present invention will be described with reference to the drawings.

Although the base configurations of an audio coding apparatus and an audio decoding apparatus according to Embodiment 3 are the same as those of the audio coding apparatus and the audio decoding apparatus according to Embodiment 1 that are illustrated in FIGS. 1 and 4, operations of the downmix compensation circuit 406 are different in Embodiment 3, which will be described in detail hereinafter.

The operations of the downmix compensation circuit 406 according to Embodiment 3 will be described.

First, the significance of the downmix compensation circuit 406 in Embodiment 3 will be described by pointing out the problems in the prior art.

FIG. 8 illustrates the configuration of the conventional SAC coding apparatus.

The downmixing unit 203 downmixes a multi-channel audio signal in a frequency domain to the intermediate downmix signal IDMX that is one of a 1-channel audio signal and a 2-channel audio signal in the frequency domain. The downmix method includes a method recommended by the ITU. The f-t converting unit 204 converts the intermediate downmix signal IDMX that is one of the 1-channel audio signal and the 2-channel audio signal in the frequency domain into a downmix signal DMX that is one of a 1-channel audio signal and a 2-channel audio signal in a time domain.

The downmix signal coding unit 205 codes the downmix signal DMX, for example, in accordance with the MPEG-AAC standard. Here, the downmix signal coding unit 205 performs an orthogonal transformation from the time domain to a frequency domain. Thus, the conversion between the time domain and the frequency domain by the f-t converting unit 204 and the downmix signal coding unit 205 causes an enormous delay.

Thus, focusing on a feature that the downmix signal in the frequency domain that is generated by the downmix signal coding unit 205 is of the same type as that of the intermediate downmix signal IDMX generated by the SAC analyzing unit 202, the f-t converting unit 204 is eliminated from the SAC coding apparatus. Then, the arbitrary downmix circuit 403 illustrated in FIG. 1 is provided as a circuit for downmixing a multi-channel audio signal to one of a 1-channel audio signal and a 2-channel audio signal, in a time domain. Furthermore, the second t-f converting unit 405 is provided for performing the same processing as conversion in the downmix signal coding unit 205 from a time domain to a frequency domain.

Here, there is a difference between (i) the original downmix signal DMX obtained by converting the intermediate downmix signal IDMX in a frequency domain into the downmix signal in a time domain using the f-t converting unit 204 in FIG. 8 and (ii) the intermediate arbitrary downmix signal IADMX that is one of a 1-channel audio signal and a 2-channel audio signal in the time domain obtained by the arbitrary downmix circuit 403 and the second t-f converting unit 405 in FIG. 1. Thus, the difference causes degradation in sound quality.

Thus, the downmix compensation circuit 406 is provided as a circuit for compensating the difference in Embodiment 3. Thus, the degradation in sound quality is prevented. Furthermore, the downmix compensation circuit 406 can reduce the delay amount in the conversion by the f-t converting unit 204 from the frequency domain to the time domain.

Next, the configuration of the downmix compensation circuit 406 according to Embodiment 3 will be described. The assumption herein is that M frequency domain coefficients can be calculated in each of coding frames and decoding frames.

The SAC analyzing unit 402 downmixes a multi-channel audio signal in a frequency domain to the intermediate downmix signal IDMX. The frequency domain coefficient corresponding to the intermediate downmix signal IDMX is expressed as x(n)(n=0,1, . . . , M−1).

On the other hand, the second t-f converting unit 405 converts the arbitrary downmix signal ADMX generated by the arbitrary downmix circuit 403 into the intermediate arbitrary downmix signal IADMX that is a signal in a frequency domain. The frequency domain coefficient corresponding to the intermediate arbitrary downmix signal IADMX is expressed as y(n)(n=0,1, . . . , M−1).

The downmix compensation circuit 406 calculates the downmix compensation information using the intermediate downmix signal IDMX and the intermediate arbitrary downmix signal IADMX. The calculation processes of the downmix compensation circuit 406 according to Embodiment 3 are as follows.

When a frequency domain is a pure frequency domain, the downmix compensation circuit 406 calculates $G_{res}$ that is downmix compensation information as a difference between the intermediate downmix signal IDMX and the intermediate arbitrary downmix signal IADMX using Equation 12.

$$G_{res}(n)=(x(n)-y(n))\ n=0,1,\ldots,M-1 \quad \text{[Equation 12]}$$

$G_{res}$ in Equation 12 is the downmix compensation information indicating the difference between the intermediate downmix signal IDMX and the intermediate arbitrary downmix signal IADMX. x(n) is a frequency domain coefficient of the intermediate downmix signal IDMX. y(n) is a frequency domain coefficient of the intermediate arbitrary downmix signal IADMX. M is the number of frequency domain coefficients calculated in each of coding frames and decoding frames.

A residual signal obtained by Equation 12 is quantized as necessary, and the redundancies are eliminated from the quantized residual signal using the Huffman coding method, and the signal multiplexed to a bit stream is transmitted to the audio decoding apparatus.

The number of results on the difference calculation in Equation 12 becomes large because no parameter set and others described in Embodiment 1 are used. Thus, the bit rate becomes higher, depending on the coding standard to be employed on the resulting residual signal. Thus, when the downmix compensation information is coded, increase in the bit rate is minimized using, for example, a vector quantization method in which the residual signal is used as a simple number stream. Since there is no need to transmit stored signals when the residual signal is coded and decoded, obviously, there is no algorithm delay.

The downmix adjustment circuit 504 of the audio decoding apparatus calculates an approximate value of the frequency domain coefficient of the intermediate downmix signal IDMX by Equation 13, using $G_{res}$ that is a residual signal and y(n) that is the frequency domain coefficient of the intermediate arbitrary downmix signal IADMX.

$$\hat{x}(n)=y(n)+G_{res}(n)\ n=0,1,\ldots,M-1 \quad \text{[Equation 13]}$$

Here, the left part of Equation 13 represents an approximate value of a frequency domain coefficient of the intermediate downmix signal IDMX. M is the number of frequency domain coefficients calculated in each of coding frames and decoding frames.

The downmix adjustment circuit 504 of the audio decoding apparatus in FIG. 4 performs calculation in Equation 13. As such, the audio decoding apparatus calculates the approximate value of the frequency domain coefficient of the intermediate downmix signal IDMX (left part of Equation 13), using (i) y(n) that is a frequency domain coefficient of the intermediate arbitrary downmix signal IADMX obtained from a bit stream and (ii) $G_{res}$ that represents the downmix compensation information. The SAC synthesis unit 505 generates a multi-channel audio signal from the approximate value of the frequency domain coefficient of the intermediate downmix signal IDMX. The f-t converting unit 506 converts the multi-channel audio signal in a frequency domain into a multi-channel audio signal in a time domain.

When the frequency domain is a hybrid domain between a frequency domain and a time domain, the downmix compensation circuit 406 calculates the downmix compensation information using Equation 14.

$$G_{res}(m,hb)=(x(m,hb)-y(m,hb))\ \text{for}\ m=0,1,\ldots,M-1;\ hb=0,1,\ldots,HB-1 \quad \text{[Equation 14]}$$

$G_{res}$ in Equation 14 is the downmix compensation information indicating the difference between the intermediate downmix signal IDMX and the intermediate arbitrary downmix signal IADMX. x(m,hb) represents a frequency domain coefficient of the intermediate downmix signal IDMX. y(m, hb) represents a frequency domain coefficient of the intermediate arbitrary downmix signal IADMX. M is the number of frequency domain coefficients calculated in each of coding frames and decoding frames. HB represents the number of hybrid bands.

Then, the downmix adjustment circuit 504 of the audio decoding apparatus in FIG. 4 calculates an approximate value of the frequency domain coefficient of the intermediate downmix signal IDMX using Equation 15.

$$\hat{x}(m,hb)=y(m,hb)+G_{res}(m,hb) \text{ for } m=0,1,\ldots,M-1;\quad hb=0,1,\ldots,HB-1 \qquad \text{[Equation 15]}$$

Here, the left part of Equation 15 represents an approximate value of a frequency domain coefficient of the intermediate downmix signal IDMX. y(m,hb) represents a frequency domain coefficient of the intermediate arbitrary downmix signal IADMX. M is the number of frequency domain coefficients calculated in each of coding frames and decoding frames. HB represents the number of hybrid bands.

The downmix adjustment circuit 504 of the audio decoding apparatus in FIG. 4 performs calculation in Equation 15. As such, the audio decoding apparatus calculates the approximate value of the frequency domain coefficient of the intermediate downmix signal IDMX (left part of Equation 15), using (i) y(m,hb) that is a frequency domain coefficient of the intermediate arbitrary downmix signal IADMX obtained from a bit stream and (ii) $G_{res}$ that represents the downmix compensation information. The SAC synthesis unit 505 generates a multi-channel audio signal from the approximate value of the frequency domain coefficient of the intermediate downmix signal IDMX. The f-t converting unit 506 converts the multi-channel audio signal in a frequency domain into a multi-channel audio signal in a time domain.

The audio coding apparatus and the audio decoding apparatus having the aforementioned configurations (1) parallelize a part of the calculation processes, (2) share a part of the filter bank, and (3) newly add a circuit for compensating the sound degradation caused by (1) and (2) and transmit auxiliary information for compensating the sound degradation as a bit stream. The configurations make it possible to reduce the algorithm delay amount in half than that by the SAC standard represented by the MPEG surround standard that enables transmission of a signal with higher sound quality at an extremely lower bit rate but with higher delay, and to guarantee sound quality equivalent to that of the SAC standard.

(Embodiment 4)

Hereinafter, a downmix compensation circuit and a downmix adjustment circuit according to Embodiment 4 in the present invention will be described with reference to the drawings.

Although the base configurations of an audio coding apparatus and an audio decoding apparatus according to Embodiment 4 are the same as those of the audio coding apparatus and the audio decoding apparatus according to Embodiment 1 that are illustrated in FIGS. 1 and 4, operations of the downmix compensation circuit 406 and the downmix adjustment circuit 504 are different in Embodiment 4, which will be described in detail hereinafter.

The operations of the downmix compensation circuit 406 according to Embodiment 4 will be described.

First, the significance of the downmix compensation circuit 406 in Embodiment 4 will be described by pointing out the problems in the prior art.

FIG. 8 illustrates the configuration of the conventional SAC coding apparatus.

The downmixing unit 203 downmixes a multi-channel audio signal in a frequency domain to the intermediate downmix signal IDMX that is one of a 1-channel audio signal and a 2-channel audio signal in the frequency domain. The downmix method includes a method recommended by the ITU. The f-t converting unit 204 converts the intermediate downmix signal IDMX that is one of the 1-channel audio signal and the 2-channel audio signal in the frequency domain into a downmix signal DMX that is one of a 1-channel audio signal and a 2-channel audio signal in a time domain.

The downmix signal coding unit 205 codes the downmix signal DMX, for example, in accordance with the MPEG-AAC standard. Here, the downmix signal coding unit 205 performs an orthogonal transformation from the time domain to a frequency domain. Thus, the conversion between the time domain and the frequency domain by the f-t converting unit 204 and the downmix signal coding unit 205 causes an enormous delay.

Thus, focusing on a feature that the downmix signal in the frequency domain that is generated by the downmix signal coding unit 205 is of the same type as that of the intermediate downmix signal IDMX generated by the SAC analyzing unit 202, the f-t converting unit 204 is eliminated from the SAC coding apparatus. Then, the arbitrary downmix circuit 403 illustrated in FIG. 1 is provided as a circuit for downmixing a multi-channel audio signal to one of a 1-channel audio signal and a 2-channel audio signal, in a time domain. Furthermore, the second t-f converting unit 405 is provided for performing the same processing as conversion in the downmix signal coding unit 205 from a time domain to a frequency domain.

Here, there is a difference between (i) the original downmix signal DMX obtained by converting the intermediate downmix signal IDMX in a frequency domain into the downmix signal in a time domain using the f-t converting unit 204 in FIG. 8 and (ii) the intermediate arbitrary downmix signal IADMX that is one of a 1-channel audio signal and a 2-channel audio signal in the time domain obtained by the arbitrary downmix circuit 403 and the second t-f converting unit 405 in FIG. 1. Thus, the difference causes degradation in sound quality.

Thus, the downmix compensation circuit 406 is provided as a circuit for compensating the difference in Embodiment 4. Thus, the degradation in sound quality is prevented. Furthermore, the downmix compensation circuit 406 can reduce the delay amount in the conversion by the f-t converting unit 204 from the frequency domain to the time domain.

Next, the configuration of the downmix compensation circuit 406 according to Embodiment 4 will be described. The assumption herein is that M frequency domain coefficients can be calculated in each of coding frames and decoding frames.

The SAC analyzing unit 402 downmixes a multi-channel audio signal in a frequency domain to the intermediate downmix signal IDMX. The frequency domain coefficient corresponding to the intermediate downmix signal IDMX is expressed as x(n)(n=0,1, . . . , M−1).

On the other hand, the second t-f converting unit 405 converts the arbitrary downmix signal ADMX generated by the arbitrary downmix circuit 403 into the intermediate arbitrary downmix signal IADMX that is a signal in a frequency domain. The frequency domain coefficient corresponding to the intermediate arbitrary downmix signal IADMX is expressed as y(n)(n=0,1, . . . , M−1).

The downmix compensation circuit 406 calculates the downmix compensation information using the intermediate downmix signal IDMX and the intermediate arbitrary downmix signal IADMX. The calculation processes of the downmix compensation circuit 406 according to Embodiment 4 are as follows.

First, a case where a frequency domain is a pure frequency domain will be described.

The downmix compensation circuit 406 calculates a predictive filter coefficient as the downmix compensation information. Methods for generating a predictive filter coefficient to be used by the downmix compensation circuit 406 include a method for generating an optimal predictive filter by the Minimum Mean Square Error (MMSE) method using the Wiener's Finite Impulse Response (FIR) filter.

Assuming the FIR coefficients of the Wiener filter as $G_{pred,i}(0)/G_{pred,i}(1), \ldots, G_{pred,i}(K-1)$, $\xi$ that is a value of the Mean Square Error (MSE) is expressed by Equation 16.

$$\xi = \sum_{n \in ps_i} \left( x(n) - \sum_{k=0}^{K-1} G_{pred,i}(k) \cdot y(n-k) \right)^2 \text{ for } i = 0, 1, \ldots, N-1 \quad \text{[Equation 16]}$$

x(n) in Equation 16 represents a frequency domain coefficient of the intermediate downmix signal IDMX. y(n) is a frequency domain coefficient of the intermediate arbitrary downmix signal IADMX. K is the number of the FIR coefficients. $ps_i$ represents a parameter set.

In Equation 16 for obtaining the MSE, the downmix compensation circuit 406 calculates, as the downmix compensation information, $G_{pred,i}(j)$ in which a differential coefficient for each element of $G_{pred,i}(i)$ is set to 0 as expressed by Equation 17.

$$\frac{\partial \xi}{\partial G_{pred,i}(j)} = 0, \text{ for } j = 0, 1, \ldots, K-1 \quad \text{[Equation 17]}$$

$$\Rightarrow G_{pred,i_{opt}} = \begin{bmatrix} G_{pred,i}(0) \\ G_{pred,i}(1) \\ M \\ G_{pred,i}(K-1) \end{bmatrix} = \Phi_{yy}^{-1} \Phi_{yx}$$

$\phi_{yy}$ in Equation 17 represents an auto correlation matrix of y(n). $\phi_{yx}$ represents a cross correlation matrix between y(n) corresponding to the intermediate arbitrary downmix signal IADMX and x(n) corresponding to the intermediate downmix signal IDMX. Here, n is an element of the parameter set $ps_i$.

The audio coding apparatus quantizes the calculated $G_{pred,i}(j)$, multiplexes the resultant to a coded stream, and transmits the coded stream.

The downmix adjustment circuit 504 of the audio decoding apparatus that receives the coded stream calculates an approximate value of the frequency domain coefficient of the intermediate downmix signal IDMX, using the prediction coefficient $G_{pred,i}(j)$ and y(n) that is the frequency domain coefficient of the received intermediate arbitrary downmix signal IADMX using the following equation.

$$\hat{x}(n) = \sum_{k=0}^{K-1} G_{pred,i}(k) \cdot y(n-k) \quad \text{[Equation 18]}$$

Here, the left part of Equation 18 represents an approximate value of a frequency domain coefficient of the intermediate downmix signal IDMX.

The downmix adjustment circuit 504 of the audio decoding apparatus in FIG. 4 performs calculation in Equation 18. As such, the audio decoding apparatus calculates the approximate value of the frequency domain coefficient of the intermediate downmix signal IDMX (left part of Equation 18), using (i) y(n) that is the frequency domain coefficient of the intermediate arbitrary downmix signal IADMX obtained by decoding a bit stream and (ii) $G_{pred,i}$ that represents the downmix compensation information. The f-t converting unit 506 converts the multi-channel audio signal in a frequency domain into a multi-channel audio signal in a time domain.

When the frequency domain is a hybrid domain between a frequency domain and a time domain, the downmix compensation circuit 406 calculates the downmix compensation information using the following equation.

$$\frac{\partial \xi}{\partial G_{pred,i}(j)} = 0, \text{ for } j = 0, 1, \ldots, K-1 \quad \text{[Equation 19]}$$

$$\Rightarrow G_{pred,i_{opt}} = \begin{bmatrix} G_{pred,i}(0) \\ G_{pred,i}(1) \\ M \\ G_{pred,i}(K-1) \end{bmatrix} = \Phi_{yy}^{-1} \Phi_{yx}$$

$G_{pred,i}(j)$ in Equation 19 is an FIR coefficient of the Wiener filter, and is calculated as a prediction coefficient in which a differential coefficient for each element of $G_{pred,i}(j)$ is set to 0.

Furthermore, $\phi_{yy}$ in Equation 19 represents an auto correlation matrix of y(m,hb). $\phi_{yx}$ represents a cross correlation matrix between y(m,hb) corresponding to the intermediate arbitrary downmix signal IADMX and x(m,hb) corresponding to the intermediate downmix signal IDMX. Here, m is an element of the parameter set $ps_i$, and hb is an element of the parameter band $pb_i$.

Equation 20 is used for calculating an evaluation function by the MMSE method.

$$\xi = \sum_{m \in ps_i} \sum_{hb \in pb_i} \left( x(m, hb) - \sum_{k=0}^{K-1} G_{pred,i}(k) \cdot y(m, hb-k) \right)^2 \quad \text{[Equation 20]}$$

x(m,hb) in Equation 20 represents a frequency domain coefficient of the intermediate downmix signal IDMX. y(m, hb) represents a frequency domain coefficient of the intermediate arbitrary downmix signal IADMX. K is the number of the FIR coefficients. $ps_i$ represents a parameter set. $pb_i$ represents a parameter band.

The downmix adjustment circuit 504 of the audio decoding apparatus calculates an approximate value of the frequency domain coefficient of the intermediate downmix signal IDMX, using a received prediction coefficient $G_{pred,i}(j)$ and y(n) that is the frequency domain coefficient of the received intermediate arbitrary downmix signal IADMX by Equation 21.

$$\hat{x}(m, hb) = \sum_{k=0}^{K-1} G_{pred,i}(k) \cdot y(m, hb-k) \text{ for } m \in ps_i, \quad hb \in pb_i \text{ and } i = 0, 1, \ldots N-1 \qquad \text{[Equation 21]}$$

Here, the left part of Equation 21 represents an approximate value of a frequency domain coefficient of the intermediate downmix signal IDMX.

The downmix adjustment circuit 504 of the audio decoding apparatus in FIG. 4 performs calculation in Equation 21. As such, the audio decoding apparatus calculates the approximate value of the frequency domain coefficient of the intermediate downmix signal IDMX (left part of Equation 21), using (i) y(n) that is a frequency domain coefficient of the intermediate arbitrary downmix signal IADMX obtained from a bit stream and (ii) $G_{pred}$ that represents the downmix compensation information. The SAC synthesis unit 505 generates a multi-channel audio signal from the approximate value of the frequency domain coefficient of the intermediate downmix signal IDMX. The f-t converting unit 506 converts the multi-channel audio signal in a frequency domain into a multi-channel audio signal in a time domain.

The audio coding apparatus and the audio decoding apparatus having the aforementioned configurations (1) parallelize a part of the calculation processes, (2) share a part of the filter bank, and (3) newly add a circuit for compensating the sound degradation caused by (1) and (2) and transmit auxiliary information for compensating the sound degradation as a bit stream. The configurations make it possible to reduce the algorithm delay amount in half than that by the SAC standard represented by the MPEG surround standard that enables transmission of a signal with higher sound quality at an extremely lower bit rate but with higher delay, and to guarantee sound quality equivalent to that of the SAC standard.

The audio coding apparatus and the audio decoding apparatus according to an implementation of the present invention can reduce the algorithm delay occurring in a conventional multi-channel audio coding apparatus and a conventional multi-channel audio decoding apparatus, and maintain a relationship between a bit rate and sound quality that is in a trade-off relationship, at high levels.

In other words, the present invention can reduce the algorithm delay much more than that by the conventional multi-channel audio coding technique, and thus has an advantage of enabling the construction of e.g., a teleconferencing system that provides a real-time communication and a communication system which brings realistic sensations and in which transmission of a multi-channel audio signal with lower delay and higher sound quality is a must.

Accordingly, the implementations of the present invention make it possible to transmit and receive a signal with higher sound quality and lower delay, and at a lower bit rate. Thus, the present invention is highly suitable for practical use, in recent days where mobile devices, such as cellular phones bring communications with realistic sensations, and where audio-visual devices and teleconferencing systems have widely spread the full-fledged communication with realistic sensations. The application is not limited to these devices, and obviously, the present invention is effective for overall bidirectional communications in which lower delay amount is a must.

Although the audio coding apparatus and the audio decoding apparatus according to the implementations of the present invention are described based on Embodiments 1 to 4, the present invention is not limited to these embodiments. The present invention includes an embodiment with some modifications on Embodiments that are conceived by a person skilled in the art, and another embodiment obtained through random combinations of the constituent elements of Embodiments in the present invention.

The present invention can be implemented not only as such an audio coding apparatus and an audio decoding apparatus, but also as an audio coding method and an audio decoding method, using characteristic units included in the audio coding apparatus and the audio decoding apparatus, respectively as steps. Furthermore, the present invention can be implemented as a program causing a computer to execute such steps. Furthermore, the present invention can be implemented as a semiconductor integrated circuit integrated with the characteristic units included in the audio coding apparatus and the audio decoding apparatus, such as an LSI. Obviously, such a program can be distributed by recording media, such as a CD-ROM, and via transmission media, such as the Internet.

Industrial Applicability

The present invention is applicable to a teleconferencing system that provides a real-time communication using a multi-channel audio coding technique and a multi-channel audio decoding technique, and a communication system which brings realistic sensations and in which transmission of a multi-channel audio signal with lower delay and higher sound quality is a must. Obviously, the application is not limited to such systems, and is applicable to overall bidirectional communications in which lower delay amount is a must. The present invention is applicable to, for example, a home theater system, a car stereo system, an electronic game system, a teleconferencing system, and a cellular phone.

Reference Signs List

101, 108, 115 Microphone
102, 109, 116 Multi-channel coding apparatus
103, 104, 110, 111, 117, 118 Multi-channel decoding apparatus
105, 112, 119 Rendering device
106, 113, 120 Speaker
107, 114, 121 Echo canceller
201, 210 Time-frequency domain converting unit (t-f converting unit)
202, 402 SAC analyzing unit
203, 408 Downmixing unit
204, 212, 506 Frequency-Time domain converting unit (f-t converting unit)
205, 404 Downmix signal coding unit
206, 409 Spatial information calculating unit
207, 407 Multiplexing device
208, 501 Demultiplexing device (separating unit)
209 Downmix signal decoding unit
211, 505 SAC synthesis unit
401 First time-frequency domain converting unit (first t-f converting unit)
403 Arbitrary downmix circuit
405 Second time-frequency domain converting unit (second t-f converting unit)
406 Downmix compensation circuit
410 Downmix signal generating unit
502 Downmix signal intermediate decoding unit
503 Domain converting unit
504 Downmix adjustment circuit
507 Multi-channel signal generating unit

The invention claimed is:

1. An audio coding apparatus that codes an input multi-channel audio signal, said apparatus comprising:

a downmix signal generating unit configured to generate a first downmix signal by downmixing in a time domain the input multi-channel audio signal according to a downmix coefficient, the first downmix signal being one of a 1-channel audio signal and a 2-channel audio signal;

a downmix signal coding unit configured to code the first downmix signal generated by said downmix signal generating unit in a bitstream with downmix compensation information;

a first t-f converting unit configured to convert the input multi-channel audio signal into a multi-channel audio signal in a frequency domain; and a spatial information calculating unit configured to generate spatial information by analyzing the multi-channel audio signal in the frequency domain, the multi-channel audio signal in the frequency domain being obtained by said first t-f converting unit, and the spatial information being information for generating a multi-channel audio signal from a downmix signal.

2. The audio coding apparatus according to claim 1, further comprising:

a second t-f converting unit configured to convert the first downmix signal generated by said downmix signal generating unit into a first downmix signal in the frequency domain;

a downmixing unit configured to downmix the multi-channel audio signal in the frequency domain to generate a second downmix signal in the frequency domain, the multi-channel audio signal in the frequency domain being obtained by said first t-f converting unit; and a downmix compensation circuit that calculates the downmix compensation information by comparing (i) the first downmix signal obtained by said second t-f converting unit and (ii) the second downmix signal generated by said downmixing unit, the downmix compensation information being information for adjusting the downmix signal, and the first downmix signal and the second downmix signal being in the frequency domain.

3. The audio coding apparatus according to claim 2, further comprising a multiplexing device configured to store the downmix compensation information and the spatial information in a same coded stream.

4. The audio coding apparatus according to claim 2, wherein said downmix compensation circuit calculates a power ratio between signals as the downmix compensation information.

5. The audio coding apparatus according to claim 2, wherein said downmix compensation circuit calculates a difference between signals as the downmix compensation information.

6. The audio coding apparatus according to claim 2, wherein said downmix compensation circuit calculates a predictive filter coefficient as the downmix compensation information.

7. An audio decoding apparatus that decodes a received bit stream into a multi-channel audio signal, said apparatus comprising:

a separating unit configured to separate the received bit stream into a data portion and a parameter portion, the data portion including a coded downmix signal, and the parameter portion including (i) spatial information for generating a multi-channel audio signal from a downmix signal and (ii) downmix compensation information for adjusting the downmix signal;

a downmix adjustment circuit that adjusts the downmix signal using the downmix compensation information included in the parameter portion before an audio signal in a time domain is obtained from the data portion, the downmix signal being obtained from the data portion and being in a frequency domain;

a multi-channel signal generating unit configured to generate a multi-channel audio signal in the frequency domain from the downmix signal adjusted by said downmix adjustment circuit using the spatial information included in the parameter portion, the downmix signal adjusted by said downmix adjustment circuit being in the frequency domain; and a f-t converting unit configured to convert the multi-channel audio signal in the frequency domain, which is generated by said multi-channel signal generating unit, into a multi-channel audio signal in the time domain.

8. The audio decoding apparatus according to claim 7, further comprising:

a downmix intermediate decoding unit configured to generate the downmix signal, which is in the frequency domain, by dequantizing the coded downmix signal included in the data portion; and a domain converting unit configured to convert the downmix signal obtained by said downmix intermediate decoding unit, which is in the frequency domain, into a downmix signal in a frequency domain having a component in a time axis direction, wherein said downmix adjustment circuit adjusts the downmix signal obtained by said domain converting unit using the downmix compensation information, the downmix signal obtained by said domain converting unit being in the frequency domain having the component in the time axis direction.

9. The audio decoding apparatus according to claim 7, wherein said downmix adjustment circuit obtains a power ratio between signals as the downmix compensation information, and adjusts the downmix signal obtained by said domain converting unit by multiplying the downmix signal obtained by said domain converting unit by the power ratio.

10. The audio decoding apparatus according to claim 7, wherein said downmix adjustment circuit obtains a difference between signals as the downmix compensation information, and adjusts the downmix signal obtained by said domain converting unit by adding the difference to the downmix signal obtained by said domain converting unit.

11. The audio decoding apparatus according to claim 7, wherein said downmix adjustment circuit obtains a predictive filter coefficient as the downmix compensation information, and adjusts the downmix signal obtained by said domain converting unit by applying, to the downmix signal obtained by said domain converting unit, a predictive filter using the predictive filter coefficient.

12. The audio decoding apparatus according to claim 7, wherein said separating unit is configured to separate the received bit stream into the parameter portion and the data portion including the coded downmix signal, the coded downmix signal being obtained by downmixing a signal in the time domain and coding the downmixed signal.

13. An audio coding and decoding apparatus, comprising:

an audio coding device configured to code an input multi-channel audio signal; and an audio decoding device configured to decode a received bit stream into a multi-channel audio signal, wherein said audio coding device includes:

a downmix signal generating unit configured to generate a first downmix signal by downmixing in a time domain the input multi-channel audio signal according to a downmix coefficient, the first downmix signal being one of a 1-channel audio signal and a 2-channel audio signal;

a downmix signal coding unit configured to code the first downmix signal generated by said downmix signal generating unit in a bitstream with downmix compensation information;

a first t-f converting unit configured to convert the input multi-channel audio signal into a multi-channel audio signal in a frequency domain;

a spatial information calculating unit configured to generate spatial information by analyzing the multi-channel audio signal in the frequency domain, the multi-channel audio signal in the frequency domain being obtained by said first t-f converting unit, and the spatial information being information for generating a multi-channel audio signal from a downmix signal;

a second t-f converting unit configured to convert the first downmix signal generated by said downmix signal generating unit into a first downmix signal in the frequency domain;

a downmixing unit configured to downmix the multi-channel audio signal in the frequency domain to generate a second downmix signal in the frequency domain, the multi-channel audio signal in the frequency domain being obtained by said first t-f converting unit; and a downmix compensation circuit that calculates downmix compensation information by comparing (i) the first downmix signal obtained by said second t-f converting unit and (ii) the second downmix signal generated by said downmixing unit, the downmix compensation information being information for adjusting the downmix signal, and the first downmix signal and the second downmix signal being in the frequency domain, and wherein said audio decoding device includes:

a separating unit configured to separate the received bit stream into a data portion and a parameter portion, the data portion including a coded downmix signal, and the parameter portion including (i) spatial information for generating a multi-channel audio signal from a downmix signal and (ii) downmix compensation information for adjusting the downmix signal;

a downmix adjustment circuit that adjusts the downmix signal using the downmix compensation information included in the parameter portion, the downmix signal being obtained from the data portion and being in a frequency domain;

a multi-channel signal generating unit configured to generate a multi-channel audio signal in the frequency domain from the downmix signal adjusted by said downmix adjustment circuit, using the spatial information included in the parameter portion, the downmix signal adjusted by said downmix adjustment circuit being in the frequency domain; and a f-t converting unit configured to convert the multi-channel audio signal in the frequency domain, which is generated by said multi-channel signal generating unit, into a multi-channel audio signal in a time domain.

14. A teleconferencing system, comprising:

an audio coding device configured to code an input multi-channel audio signal; and an audio decoding device configured to decode a received bit stream into a multi-channel audio signal, wherein said audio coding device includes:

a downmix signal generating unit configured to generate a first downmix signal by downmixing in a time domain the input multi-channel audio signal according to a downmix coefficient, the first downmix signal being one of a 1-channel audio signal and a 2-channel audio signal;

a downmix signal coding unit configured to code the first downmix signal generated by said downmix signal generating unit in a bitstream with downmix compensation information;

a first t-f converting unit configured to convert the input multi-channel audio signal into a multi-channel audio signal in a frequency domain;

a spatial information calculating unit configured to generate spatial information by analyzing the multi-channel audio signal in the frequency domain, the multi-channel audio signal in the frequency domain being obtained by said first t-f converting unit, and the spatial information being information for generating a multi-channel audio signal from a downmix signal;

a second t-f converting unit configured to convert the first downmix signal generated by said downmix signal generating unit into a first downmix signal in the frequency domain;

a downmixing unit configured to downmix the multi-channel audio signal in the frequency domain to generate a second downmix signal in the frequency domain, the multi-channel audio signal in the frequency domain being obtained by said first t-f converting unit; and a downmix compensation circuit that calculates downmix compensation information by comparing (i) the first downmix signal obtained by said second t-f converting unit and (ii) the second downmix signal generated by said downmixing unit, the downmix compensation information being information for adjusting the downmix signal, and the first downmix signal and the second downmix signal being in the frequency domain, and wherein said audio decoding device includes:

a separating unit configured to separate the received bit stream into a data portion and a parameter portion, the data portion including a coded downmix signal, and the parameter portion including (i) spatial information for generating a multi-channel audio signal from a downmix signal and (ii) downmix compensation information for adjusting the downmix signal;

a downmix adjustment circuit that adjusts the downmix signal using the downmix compensation information included in the parameter portion, the downmix signal being obtained from the data portion and being in a frequency domain;

a multi-channel signal generating unit configured to generate a multi-channel audio signal in the frequency domain from the downmix signal adjusted by said downmix adjustment circuit using the spatial information included in the parameter portion, the downmix signal adjusted by said downmix adjustment circuit being in the frequency domain; and a f-t converting unit configured to convert the multi-channel audio signal in the frequency domain, which is generated by said multi-channel signal generating unit, into a multi-channel audio signal in a time domain.

15. An audio coding method for coding an input multi-channel audio signal, said method comprising:

generating a first downmix signal by downmixing in a time domain the input multi-channel audio signal according to a downmix coefficient, the first downmix signal being one of a 1-channel audio signal and a 2-channel audio signal;

coding the first downmix signal generated in said generating of a first downmix signal in a bitstream with downmix compensation information;

converting the input multi-channel audio signal into a multi-channel audio signal in a frequency domain; and generating spatial information by analyzing the multi-channel audio signal in the frequency domain, the multi-channel audio signal in the frequency domain being obtained in said converting, and the spatial information being information for generating a multi-channel audio signal from a downmix signal.

16. An audio decoding method for decoding a received bit stream into a multi-channel audio signal, said method comprising:

separating the received bit stream into a data portion and a parameter portion, the data portion including a coded downmix signal, and the parameter portion including (i) spatial information for generating a multi-channel audio signal from a downmix signal and (ii) downmix compensation information for adjusting the downmix signal;

adjusting the downmix signal using the downmix compensation information included in the parameter portion before an audio signal in a time domain is obtained from the data portion, the downmix signal being obtained from the data portion and being in a frequency domain;

generating a multi-channel audio signal in the frequency domain from the downmix signal adjusted in said adjusting using the spatial information included in the parameter portion, the downmix signal adjusted in said adjusting being in the frequency domain; and converting the multi-channel audio signal in the frequency domain, which is generated in said generating, into a multi-channel audio signal in the time domain.

17. A non-transitory computer readable recording medium having stored thereon a program for an audio coding apparatus that codes an input multi-channel audio signal, wherein the program causes a computer to execute the audio coding method according to claim 15.

18. A non-transitory computer readable recording medium having stored thereon a program for an audio decoding apparatus that decodes a received bit stream into a multi-channel audio signal, wherein the program causes a computer to execute the audio decoding method according to claim 16.

* * * * *